US009516946B1

(12) United States Patent
Edwards

(10) Patent No.: US 9,516,946 B1
(45) Date of Patent: Dec. 13, 2016

(54) FREESTANDING DESKTOP STORAGE UNIT FOR SUPPORT OF A PRIVACY PANEL

(71) Applicant: John R. Edwards, Thornbury (CA)

(72) Inventor: John R. Edwards, Thornbury (CA)

( * ) Notice: Subject to any disclaimer, the term of this patent is extended or adjusted under 35 U.S.C. 154(b) by 0 days.

(21) Appl. No.: 14/734,143

(22) Filed: Jun. 9, 2015

(51) Int. Cl.
*A47B 21/00* (2006.01)
*A47B 83/04* (2006.01)
*A47B 83/00* (2006.01)

(52) U.S. Cl.
CPC ..... *A47B 83/045* (2013.01); *A47B 21/00* (2013.01); *A47B 83/001* (2013.01); *A47B 2220/0052* (2013.01); *A47B 2220/0061* (2013.01)

(58) Field of Classification Search
CPC ..... A47B 83/045; A47B 83/001; A47B 2220/0052; A47B 2220/0061
See application file for complete search history.

(56) References Cited

U.S. PATENT DOCUMENTS

| | | | | |
|---|---|---|---|---|
| 2,590,959 | A * | 4/1952 | Granditer | A47B 83/045 108/33 |
| 2,869,956 | A * | 1/1959 | Gaines | A47B 83/045 108/93 |
| 6,286,275 | B1 | 9/2001 | Edwards | |
| 6,735,908 | B2 | 5/2004 | Edwards | |
| 2008/0211361 | A1* | 9/2008 | Boxenbaum | A47B 51/00 312/196 |
| 2011/0303127 | A1* | 12/2011 | Fryshman | A47B 83/001 108/50.11 |
| 2012/0304441 | A1* | 12/2012 | Henriott | A47B 13/00 29/428 |
| 2014/0318423 | A1* | 10/2014 | Parshad | A47B 83/001 108/60 |

* cited by examiner

*Primary Examiner* — Daniel Rohrhoff
(74) *Attorney, Agent, or Firm* — Riches, McKenzie & Herbert LLP

(57) ABSTRACT

A desktop storage cabinet adapted to sit on a desktop and support a privacy panel. The storage cabinet includes an integrated horizontal slide pocket along its back open at least a first end of the storage element and adapted to receive and support a privacy panel which extends from within the slide pocket outwardly beyond the pocket.

20 Claims, 22 Drawing Sheets

FREESTANDING DESKTOP STORAGE UNIT FOR SUPPORT OF A PRIVACY PANEL

SCOPE OF THE INVENTION

This invention relates to a storage element to be mounted on a worksurface as of a desk which supports a privacy panel.

BACKGROUND OF THE INVENTION

Furniture used to create workstations for many years have consisted of elaborate cubicles surrounding multiple worksurfaces. The cubicles consist of freestanding furniture panels linked together in clusters of typically two to six workstations. The panels are robust and support not only worksurfaces as, for example, in the form of desks but also storage elements and utility distribution elements such as electrical and communication wiring and outlets.

In recent times, there has been a move in office environments towards more simplified workstations which are less elaborate and more cost effective. These workstations consist of table or desk-like surfaces with a minimum of integrated storage components. The use of robust panels capable of supporting a desktop surface and storage have been reduced and in lieu of such robust panels, lightweight privacy screens have been provided adjacent the desks or secured to the desk at the front edge of a table or desk. In addition, because of a decline in the amount of paper files being stored by workers, the storage requirements within the work area is changing. Personal items, notably including small portable electronic devices and small desktop accessories are typical items that require storage. Storage for filing of paper in larger amounts are typically filed in freestanding file bins or file cabinets adjacent or located under the table or desk.

The applicant has appreciated that previously known devices have the disadvantage of not providing a low-cost product or method which provides storage at the desk level for small amounts of paper files, binders and personal items and/or a low-cost privacy screen.

SUMMARY OF THE INVENTION

To at least partially overcome these disadvantages of the previously known devices, the present invention provides a simple desktop storage cabinet with an integrated horizontal slide pocket along its back open at least a first end of the storage element and adapted to receive and support a privacy panel which extends from within the slide pocket outwardly beyond the pocket.

In a first aspect, the present invention provides in combination a privacy panel and at least one storage element:

the storage element comprising:

a front, a back, a top extending between the back and the front, a bottom spaced vertically from the top extending between the back and the front, a first end extending between the top and the bottom and between the back and the front, and a second end between the top and the bottom opposite the first end and between the back and the front;

a vertical outer rear wall panel forming the back of the storage element;

a storage compartment open to the front between the top, the bottom, the first end, and the second end;

a vertically and horizontally extending slide pocket defined inward of the outer rear wall panel, parallel to the outer rear wall panel, and open to at least one of the first end and the second end via an access opening in a respective one of the first end and the second end;

the privacy panel comprising a thin sheet-like member with a first end and a second end;

the privacy panel coupled to storage element with a captured portion of the privacy panel including the first end received within the pocket and with a free portion of the privacy panel external of the pocket extending out of the pocket via the access opening to the second end of the panel external of the pocket;

the captured portion horizontally slidable in the pocket through the access opening, wherein when the captured portion of the privacy panel is received within the pocket with the privacy panel extending out of the pocket to the second end external of the pocket, engagement between the privacy panel and the pocket maintaining the privacy panel disposed vertical parallel to the outer rear wall panel.

Preferably, in the first aspect, the slide pocket includes a rearwardly facing front guide surface located between the first end and the second end spaced from the access opening for constraining the privacy panel in the slide pocket between the front guide surface and the outer rear wall panel. Preferably, in the first aspect, an inner rear wall panel extends parallel to the outer rear wall panel spaced inwardly from the outer rear wall panel; and the slide pocket is defined inward between of the outer rear wall panel parallel to the outer rear wall panel and the inner rear wall panel. Preferably, in the first aspect, the storage compartment is forward of the inner rear wall panel. Preferably, in the first aspect, the access opening has a rearwardly directed front guide surface and a forwardly directed rear guide surface for constraining the privacy panel in the slide pocket between the front guide surface and the rear guide surface.

Preferably, in the first aspect, the bottom is adapted for supporting the storage element on a horizontal surface in a normal orientation, and the top is adapted for supporting the storage element on the horizontal surface in a normal orientation.

Preferably, in the first aspect, the storage element is invertible and adapted for use either in a normal orientation with the bottom supporting the storage element on a horizontal support surface or in an inverted orientation with the bottom wall supporting the storage element on the support surface.

Preferably, in the first aspect, the pocket is open via the access opening at the first end and the pocket closed at the second end.

In the first aspect, the privacy panel may further have a front face, a rear face, a top, and a bottom;

when the captured portion of the privacy panel is received within the pocket with the privacy panel extending out of the pocket to the second end external of the pocket engagement between the front face and the inner rear wall panel and between the rear face and the outer rear wall panel maintaining the panel disposed vertically and parallel to the outer rear panel. Preferably, a horizontal width between the front face and the rear face is marginally smaller than a horizontal width of the pocket between the outer rear wall panel and the inner rear wall panel.

Preferably, in the first aspect, the privacy panel having a vertical cross-sectional size and shape complementary to a vertical cross-sectional size and shape of the pocket whereby when the captured portion of the privacy panel is received in the pocket engagement between the captured portion of the privacy panel and pocket maintains the privacy panel disposed vertical parallel to the outer rear wall panel.

Preferably, in the first aspect, the first end comprising a first end wall panel extending between the top and the bottom.

the second end comprising a second end wall panel wall extending between the top and the bottom opposite the first end wall panel, and the inner rear wall panel extending between the first end wall panel and the second end wall panel. Preferably, with the outer rear wall panel extending between the first end and the second end wall panel. Preferably, the top comprises a horizontal top wall panel extending between the first end wall panel and the second end wall panel.

the bottom comprises a horizontal bottom wall panel spaced vertically from the top wall panel and extending between the first end wall panel and the second end wall panel, the inner rear wall panel extending between the first end wall panel and the second end wall panel and extending between the top wall panel and the bottom wall panel, and the outer rear wall panel extending between the first end and the second end wall panel and extending between the top wall panel and the bottom wall panel. Preferably, the first end wall panel is vertical, and the second end wall panel is vertical, parallel to the first end wall and normal to the outer rear wall panel. Preferably, the pocket is defined between the outer rear panel and the inner rear wall panel and between the top wall panel and the bottom wall panel. Preferably, the top wall panel has a top thickness between an exterior surface of the top wall panel and an interior surface of the top wall panel, the bottom wall panel has a bottom thickness between an exterior surface of the bottom wall panel and an interior surface of the bottom wall panel; the top thickness equal to the bottom thickness; the interior surface of the top wall panel and the interior surface of bottom wall panel defining the pocket vertically there between such that when the panel is received in the pocket the bottom of the privacy panel over the captured portion engages the interior surface of one of the bottom wall panel and the top wall panel. Preferably, the bottom is adapted for supporting the storage element on a horizontal surface in a normal orientation, and the bottom of the privacy panel on the free portion of the privacy panel is adapted to support the privacy panel on the horizontal surface. Preferably, the bottom of the privacy panel on the free portion of the privacy panel that is adapted to support the privacy panel on the horizontal surface is spaced vertically from the bottom of the privacy panel on the captured portion of the privacy panel that engages the interior surface of one of the bottom wall panel and the top wall by a vertical distance at least equal to the bottom thickness so as to support the privacy panel to extend horizontally when the free portion of the privacy panel engages the support surface and the captured portion of the privacy panel is supported on the storage element supported on the support surface.

Preferably, in the first aspect, the storage element has a mass, and the storage panel has a mass, and the mass of the storage element is at least twice the mass of the privacy panel.

In a second aspect, the present invention provides in combination a privacy panel and two storage elements, namely a first storage element and a second storage element:

each storage element comprising:

a front, a back, a top extending between the back and the front, a bottom spaced vertically from the top extending between the back and the front, a first end extending between the top and the bottom and between the back and the front, and a second end between the top and the bottom opposite the first end and between the back and the front;

a vertical outer rear wall panel forming the back of the storage element;

a storage compartment open to the front and defined between the top, the bottom, the first end, and the second end;

a slide pocket defined inward of the outer rear wall panel parallel to the outer rear wall panel;

the pocket open to at least one of the first end and the second end via an access opening in a respective one of the first end and the second end;

the privacy panel comprising a thin sheet-like member with a first end and a second end;

the privacy panel removably coupled to each storage element with a first captured portion of the privacy panel including the first end received within the pocket of the first storage unit, a second captured portion of the privacy panel including the second end received within the pocket of the second storage element and with a free portion of the privacy panel between the first captured portion and the second captured portion external of the pockets extending out of the pockets via the access openings and between the first storage element and the second storage element.

the first captured portion horizontally slidable in the pocket of the first storage unit through the access opening, the second captured portion horizontally slidable in the pocket of the second storage unit through the access opening;

wherein when the first storage element and the second storage element are supported on a support surface with the outer rear panel of the first storage element disposed in the same plane as the outer rear panel of the second, with the first captured portion of the privacy panel received within the pocket of the first storage element and the second captured portion of the privacy panel received within the pocket of the second storage element, engagement between the privacy panel and the pockets maintains the privacy panel disposed parallel to the outer rear wall panel.

In a third aspect, the present invention provides in combination a privacy panel and two storage elements, namely a first storage element and a second storage element:

each storage element comprising:

a front, a back, a top extending between the back and the front, a bottom spaced vertically from the top extending between the back and the front, a first end extending between the top and the bottom and between the back and the front, and a second end between the top and the bottom opposite the first end and between the back and the front;

a vertical outer rear wall panel forming the back of the storage element;

an inner rear wall panel extending parallel to the outer rear wall panel spaced inwardly from the outer rear wall panel;

a storage compartment open to the front and defined forward of the inner rear wall panel between the top, the bottom, the first end, and the second end;

a slide pocket defined between the outer rear wall panel and the inner rear wall panel;

the pocket open to at least one of the first end and the second end via an access opening in a respective one of the first end and the second end;

the privacy panel comprising a thin sheet like member with a first end and a second end;

the privacy panel removably coupled to each storage element with a first captured portion of the privacy panel including the first end received within the pocket of the first storage unit, a second captured portion of the privacy panel including the second end received within the pocket of the second storage element and with a free portion of the privacy panel between the first captured portion and the second captured portion external of the pockets extending out of the pockets via the access openings and between the first storage element and the second storage element, wherein when the first storage element and the second storage element are supported on a support surface with the outer rear panel of the first storage element disposed in the same plane as the outer rear panel of the second, with the first captured portion of the privacy panel received within the pocket of the first storage element and the second captured portion of the privacy panel received within the pocket of the second storage element, engagement between the privacy panel and the pockets maintains the privacy panel disposed parallel to the outer rear wall panel.

Preferably, in the second and third aspects, the first storage element and the second storage element are identical.

Preferably, in the second and third aspects, the first storage element and the second storage element are identical, each storage element is invertible and adapted for use either in a normal orientation with the bottom supporting the storage element on a horizontal support surface or in an inverted orientation with the bottom wall supporting the storage element on the support surface, and the pocket in each storage is open via the access opening at the first end and the pocket closed at the second end.

Preferably, in the second and third aspects, the second storage element is a mirror image of the first storage element.

Preferably, the second and third aspects include a desking arrangement with a worksurface comprising the support surface, the support surface having a first work area for a first user to be positioned adjacent a first edge of the worksurface facing the first work area and a second work area for a second user to be positioned adjacent a second edge of the worksurface opposite from the first edge facing the second work area and the first work area, the first storage element on the first work area with the front of the first storage element facing the first edge, the second storage element on the second work area spaced from the first storage element with the front of the second storage element facing the second edge, the privacy panel spanning between the first storage element and the second storage element received in the respective pocket of each. Preferably, the first work area ends at a first straight back edge and the second work area ends at a second back edge, the second back edge being parallel to the first back edge in opposition thereto on other side of a vertical center plane, the first storage element located on the first work area with its outer rear panel spaced away from the first edge from the first back edge and the second storage located on the second work area with its outer rear panel spaced away from the second edge from the second back edge, whereby the privacy panel in spanning between the first storage element and the second storage element received in the respective pocket of each storage element overlies the vertical center plane.

Preferably, in the first aspect, the privacy panel comprises an element selected from a window, a mirror, a tack board, a whiteboard, a magnetic board and a picture frame.

Preferably, in the first aspect, the storage element includes an electrical power or a communication outlet and a flexible connection wiring for connection of the outlet with a source of electrical power or communication. Preferably, the pocket is open via the access opening at the first end and the pocket closed at the second end, the outlet is provided in a location selected from the storage compartment, the front, and first side, and the wiring extends either from the storage element at second side or from the storage element from the rear panel proximate the second side.

BRIEF DESCRIPTION OF THE DRAWINGS

Further aspects and advantages of the present invention will become apparent from the following description taken together with the accompanying drawings in which:

FIG. 1 is a pictorial view of a first embodiment of a storage element and privacy panel coupled together to form a storage panel assembly in a first configuration of the present invention as mounted on a desk;

DETAILED DESCRIPTION OF THE DRAWINGS

Figure 2:
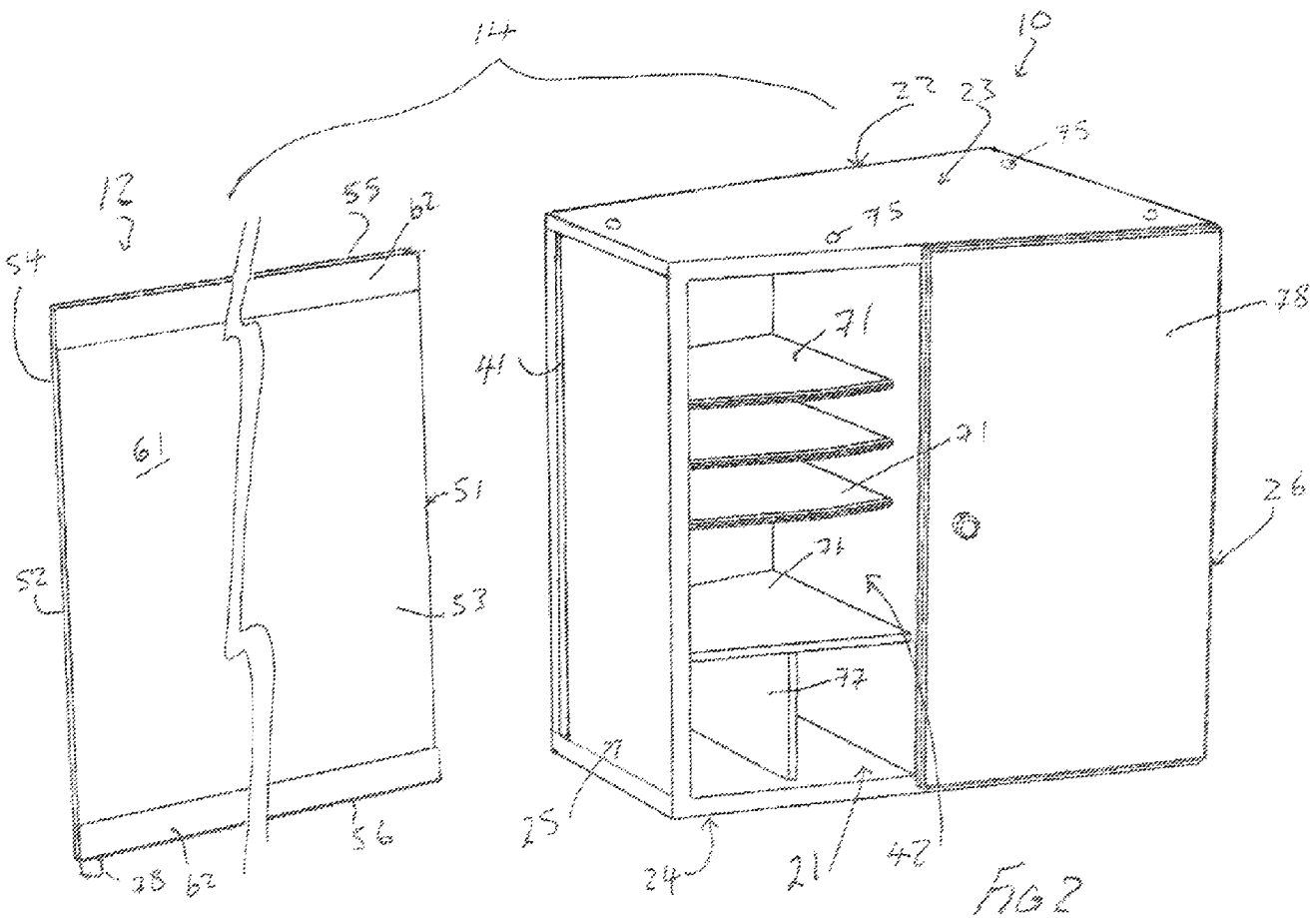
FIG. 2 is a front perspective view of the storage element and privacy panel of FIG. 1 uncoupled.
Figure 3:
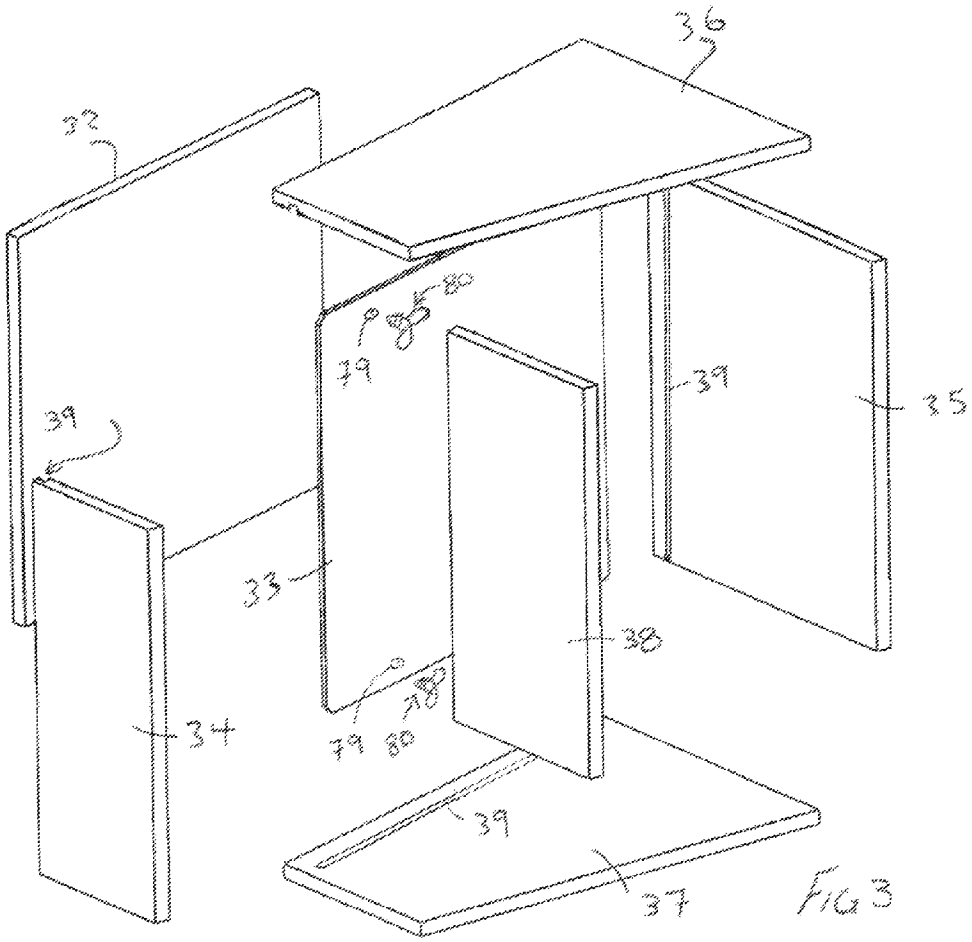
FIG. 3 is an exploded front perspective view of selected elements of the storage element of FIG. 1.
Figures 4, 5:
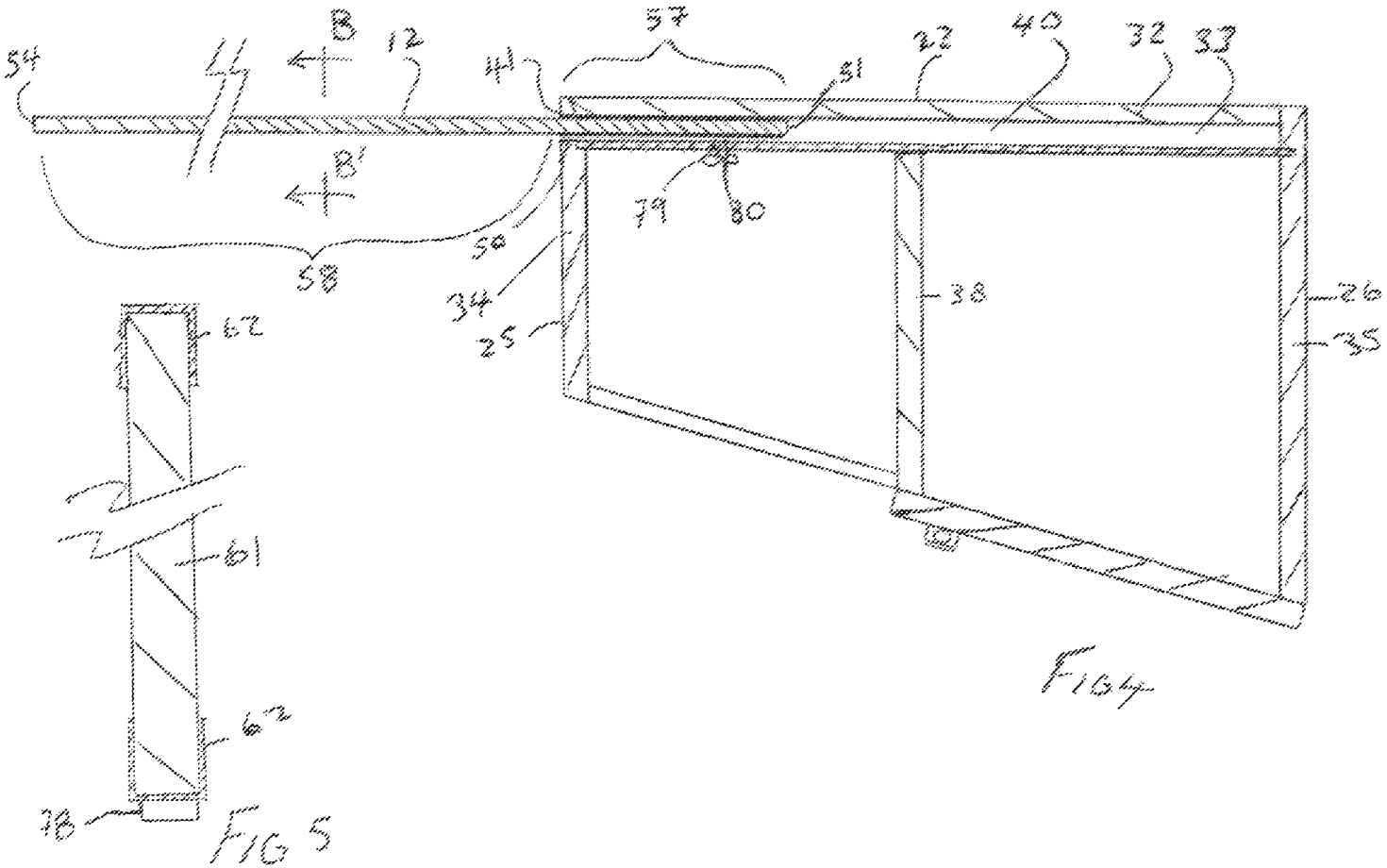
FIG. 4 is a cross-sectional top view of the storage and panel assembly of FIG. 1 along section line A-A' in FIG. 1.
FIG. 5 is a cross-sectional end view of the privacy panel along section line B-B' in FIG. 4.

Reference is made first to FIGS. 1 to 5 which illustrate a storage element 10 and a privacy panel 12 in accordance with a first embodiment of the present invention. As seen in FIGS. 1 and 4, the storage element 10 and the privacy panel 12 are assembled to form a storage and panel assembly 14 in a first orientation. As seen in FIG. 1, the storage panel assembly 14 is supported on a support surface 16 of a desk 18.

Referring to FIGS. 2, 3 and 4, the storage element 10 includes:

a front 21, a back 22, a top 23 extending between the front 21 and the back 22, a bottom 24 spaced vertically from the top 23 and extending between the front 21 and the back 22, a first end 25 extending between the top 23 and the bottom 24 and between the front 21 and the back 22, and a second end 26 opposite the first end 25, extending between the top 23 and the bottom 24 and extending between the front 21 and the back 22.

As can best be seen in FIGS. 3 and 4, a vertical outer rear wall panel 32 forms the back 22 of the storage element 10. An inner rear wall panel 33 is provided extending parallel to the outer rear wall panel 32 spaced inwardly, that is, forwardly from the outer rear wall panel 32. A slide pocket 40 is defined between the outer rear wall panel 32 and the inner rear wall panel 33. The slide pocket 40 is open to the first end 25 via an access opening 41 in the first end 25 as best seen in FIG. 2. A storage compartment 42 is defined within the storage element 10 open to the front 21.

The privacy panel 12 comprises a thin sheet-like member with a first end 51, a second end 52, a front face 53, a rear face 54, a top 55 and a bottom 56. The privacy panel 12 and the storage element 10 are preferably separate elements which can be removably coupled together. The privacy panel 12 is shown in FIG. 2 as a separate element uncoupled from the storage element 10. In FIGS. 1 and 4, the privacy panel 12 is shown as coupled to the storage element 10 with the first end 51 of the privacy panel 12 received within the slide pocket 40 and the privacy panel extending out of the slide pocket 40 via the access opening 41 to the second end 52 of the panel external of the slide pocket 40.

As can be seen on FIG. 4, a portion of the privacy panel 12 including the first end 51 that is received within the slide pocket 40 is designated as a captured portion 57 and a portion of the privacy panel 12 external of the slide pocket 40 is designated as a free portion 58. In the storage and panel assembly 14 with the captured portion 57 of the privacy panel 12 received within the slide pocket 40 with the privacy panel 12 extending out of the slide pocket 40 to the second end external of the pocket, engagement between captured portion 57 of the privacy panel 12 and the slide pocket 40 maintains the privacy panel 12 disposed vertical and parallel to the outer rear wall panel 32. The captured portion 57 including the first end 51 of the privacy panel is horizontally slidable into and out of the slide pocket 40 through the access opening 41. Thus, the privacy panel 12 is removable from the slide pocket 40 and insertable into the slide pocket 40 when it is removed from the slide pocket 40. The slide pocket 40 is open via the access opening 41 at the first end 25. In the first embodiment, the slide pocket 40 is closed at the second end 26.

The extent that the privacy panel 12 when coupled to the storage element 10 extends outwardly from the storage element 10 may be varied by locating the first end 51 of the privacy panel 12 at different relative positions between the first end 25 and the second end 26 within the slide pocket 40, thus varying the relative horizontal length of each of the captured portion 57 and the free portion 58. This is advantageous since having regard to the length of the slide pocket 40 between the first end 25 and the second end 26 and the length of the privacy panel 12, a resultant storage and panel assembly 14 may have its overall length varied so as to provide the storage and panel assembly 14 with varying overall lengths which can accommodate desks 18 with worksurfaces 16 of different lengths yet still permit the storage element 10 and privacy panel 12 to extend the full length of the different length storage surfaces 16.

As can be seen in FIGS. 1 and 2, the privacy panel 12 has a vertical cross-sectional size and shape complementary to a vertical cross-sectional size and shape of the slide pocket 40 whereby when the captured portion 57 of the privacy panel 12 is received in the slide pocket 40 engagement between the captured portion 57 of the privacy panel 12 and the slide pocket 40 maintains the privacy panel 12 disposed vertical and parallel to the outer rear wall panel 32. As can be seen in FIG. 4, when the captured portion 57 of the privacy panel 12 is received within the slide pocket 40, engagement between the rear face 54 of the privacy panel 12 and the outer rear wall panel 32 maintains the privacy panel 40 disposed vertically and parallel to the outer rear wall panel 32. It is to be appreciated, however, that as seen in FIG. 4, a horizontal width of the privacy panel 40 between the front face 53 and the rear face 54 is marginally smaller than a horizontal width of the slide pocket 40.

As seen in FIG. 3, two circular openings 79 are provided through the inner rear wall panel 33 at vertical heights horizontally aligned with the edge caps 62 of the privacy panel 12. Securement screws 80 are adapted to be threaded in these openings 79 as inserted from within these storage compartment 42 into engagement with the end caps 62 of the privacy panel 12 to fix the horizontal location of the privacy panel 12 within the slide pocket 40 and thus relative to the storage element 10 as seen in FIG. 4. Preferably, each of the screws 80 may be of a soft plastic and have a wing nut 81 permitting manual rotation by a person's fingers without the need of tools. Alternatively, a T-nut may be fixed in the opening the 79 and a soft plastic tipped grub screw with a hexagonal head recess be threadably engaged in the nut as for tightening with a hex headed driver.

Reference is made to FIG. 3 which shows main components of the storage element 10 which includes the outer rear wall panel 32, the inner rear wall panel 33, a first end wall panel 34, a second end wall panel 35, a horizontal top wall panel 36, a horizontal bottom wall panel 37 and a divider wall panel 38 as are secured together in a manner as shown in FIGS. 2 and 4. As shown, interior surfaces of each of the first end wall panel 34 and the second end wall panel 35, the top wall panel 36 and the bottom wall panel 37 carry respective slots 39 to securely receive therein edges of the inner rear wall panel 32. The slot 39 in the first end wall panel 34 is a rabbit open to the rear end of the first end wall panel 34 so that when assembled a rear face of the inner rear wall panel 33 is flush with the rear end of the first end wall panel 34, and the slide pocket has a constant front to rear width. The slide pocket 40 is defined at its rear by a forwardly facing interior guide surface comprising forward face of the outer rear wall panel 32. The slide pocket 40 is defined at its front by a rearwardly facing interior guide surface comprising the rear face of the inner rear wall panel 33. The rearwardly facing front guide surface is preferably located between the first end and the second end spaced from the access opening 40 for constraining the privacy panel 14 in the slide pocket 40 between the front guide surface and the rear guide surface of the outer rear wall panel 32.

The slide pocket 40 is defined at its bottom by an upwardly directed bottom guide surface comprising a top face of the bottom wall panel 37 between the forwardly facing interior guide surface and the rearwardly facing interior guide surface. The slide pocket is defined at its top by a downwardly facing top guide surface comprising a bottom face of the top wall panel 36 between the forwardly facing interior guide surface and the rearwardly facing interior guide surface. As seen from FIG. 3, the slide pocket 40 has a constant top to bottom height between the top wall panel 36 and the bottom wall panel 37. When the storage element 10 is in a normal condition, the bottom 57 of the privacy panel 12 slides on the upwardly directed bottom guide surface of the bottom wall panel 37. If the storage element 10 is in an inverted condition, the top 56 of the privacy panel 12 slides on the downwardly directed top guide surface of the top wall panel 36.

The storage compartment 42 is defined open to the front 21. The storage compartment 42 is effectively bounded by the back 22, top 23, bottom 24, first end 25 and the second end 26. As seen in FIG. 3, the storage compartment 42 is defined between the first end wall panel 34 and the second end wall panel 35 and between the top wall panel 36 and the bottom wall panel 37 forwardly of the inner rear wall panel 33. As seen in FIG. 3, a vertical dividing wall 38 is provided between the first end wall panel 34 and the second end wall panel 35. A first portion of the storage compartment 42 between the first end wall panel 34 and the dividing wall 38 is sub-divided by horizontal shelves 76 and a vertical divider 77 which are preferably removable and reconfigurable. A second portion of the storage compartment 42 between the divider wall 38 and the second end wall panel 35 is shown as being closed by a door 78 hinged or pivoting about a vertical axis to the second end wall panel 35.

Referring to FIGS. 2 and 5, the privacy panel 12 is shown as being formed from a planar sheet member 61 with its top and bottom edges received within thin preferably aluminum extruded edge trim caps 62 which protect the top and bottom edges of the sheet member 61 and provide increased rigidity. The sheet member 61 may, for example, serve purposes over its entirety or portions as being a cork board, chalk board, a window or an aperture in which a photograph may be placed, without any particular limitation. The nature of the sheet member 61 is not limited and may comprise, for example, opaque plastic or glass, cork board, cardboard, metal and various other sheet members which may or may not be composites.

As seen in FIGS. 1, 2 and 5, a levelling foot 78 is provided secured to the lower edge trim cap 62 proximate the second end 52 of the privacy panel 12. The levelling tool 78 is provided so as to space the edge trim cap 62 from the support surface 16 of the desk 18 the same distance that the edge trim cap 62 is spaced from the support surface 16 of the desk 18 by the storage element 10, so as to locate the privacy panel 12 disposed to be parallel to the support surface 16 and thus, preferably, horizontal.

The levelling foot 78 may have a threaded mechanism to adjust its height, however, typically may merely be set at a constant height.

Referring to FIG. 1, the storage and panel assembly 14 is shown in the first orientation in which the storage element 10 and the privacy panel 12 are supported on the support surface 16 of a desk 18. The desk has a front edge 64, a rear edge 65, a first side edge 66 and a second side edge 67. The support surface 16 is preferably horizontal. The storage element 10 is located on the right hand side of the desk 18 near the second side 67 of the desk 18 and with the privacy panel 12 to extend from the storage element 10 towards the first side 66 of the desk 18.

The storage element 10 is preferably freestanding on the support surface 16, that is, with the bottom 24 of the storage element 10 engaged on the support surface 16 as shown. Preferably, the bottom 24 carries friction engaging elements or pads 75 for engaging the support surface 16 to resist relative movement of the storage element 10 on the support surface and to prevent marring of the support surface 16 by movement or placement of the storage element 10. These pads 75 are illustrated in FIGS. 1 and 2 as circular pads shown secured to the top 23, however, similar pads are to be applied to the bottom 24. Such pads are known and may be secured, preferably removably to the top 23 and the bottom 24 as by adhesives and the may comprise, for example, rubber or felt-like material. The thickness of the pads 75 needs to be accounted for in selecting the height of the levelling foot 78.

Figure 6:
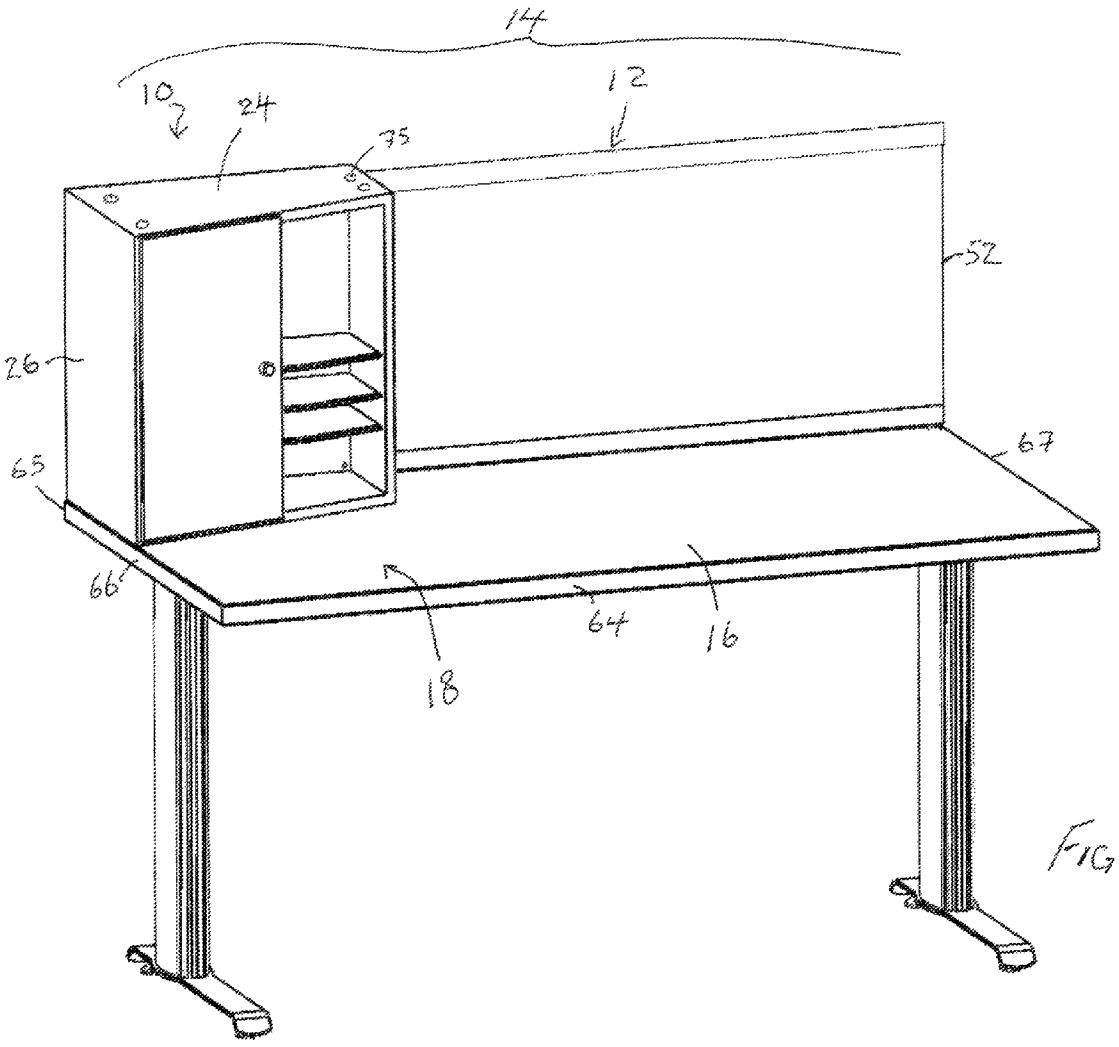
FIG. 6 is a pictorial view of the storage panel assembly of the first configuration of FIG. 1 with a storage element in an inverted condition.
Figure 7:
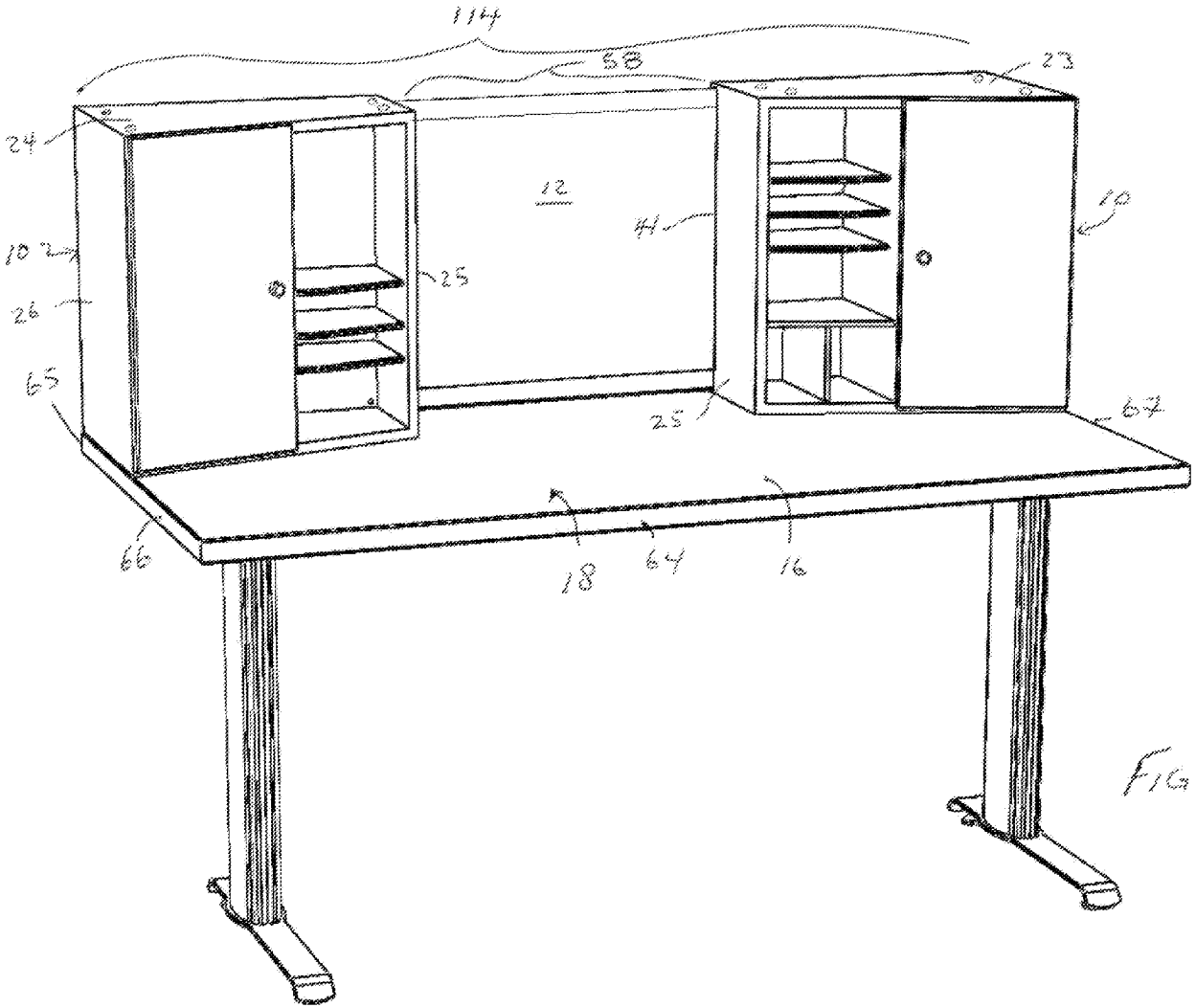

Reference is made to FIG. 6 which shows the storage element 10 and privacy panel 12 of FIGS. 2 and 4, however, as located on the same desk 18 as in FIG. 1 but with the storage element 10 in an inverted condition located on the right hand side of the desk 18 proximate the first side 66 of the desk and with the privacy panel 12 to extend from the storage element 10 towards the second side 67 of the desk 18. For ease of comprehension, the interior shelves 76 and divider 74 are shown as being in an inverted condition, however, the shelves 76 and the divider 74 may be removed and reconfigured as desired.

In FIG. 6, the storage element 10 is supported on the support surface 16 of the desk 18 with the top 23 engaging the support surface 16 and with the bottom 24 directed vertically upwardly. The privacy panel 12 is shown as having its second end 52 engaged within the storage element 10 with the first end carrying the locating foot 63 supported by the support surface 16 of the desk 18 remote from the storage element 10.

Figure 7:
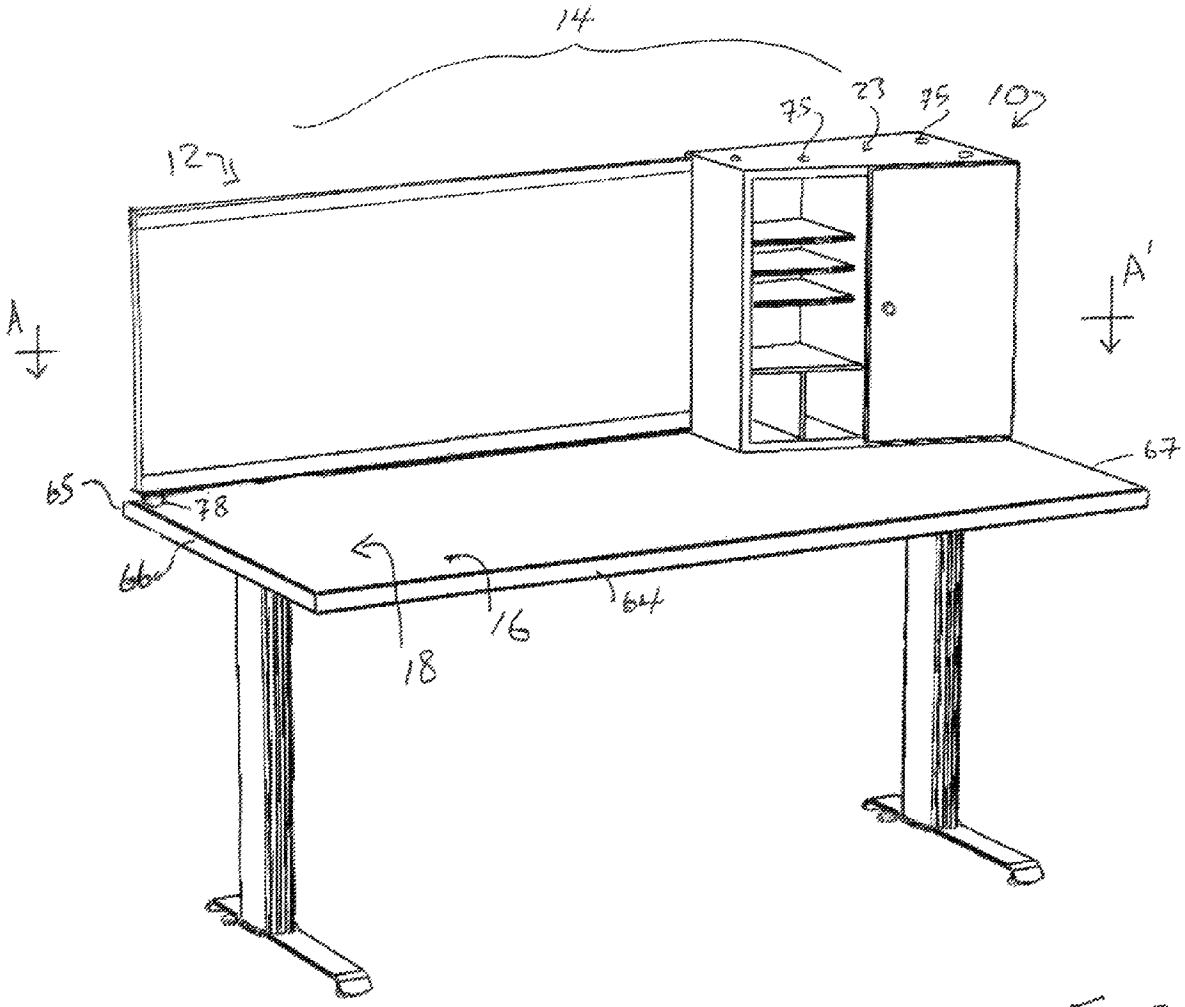
FIG. 7 is a pictorial front view of storage elements and privacy panel of the first embodiment of FIG. 1 arranged as a storage and panel assembly in a second configuration mounted on two desks.

Reference is made to FIG. 7 which illustrates a storage and panel assembly 114 in a second configuration utilizing two storage elements 10 of the same construction as shown in FIG. 2 on a single desk 18 and both facing the front edge 64 in combination with a single privacy panel 12 the same as that shown in FIGS. 1 to 5 but with the levelling foot 78 removed. As 10 is disposed in a normal condition being the same as that in which the storage element 10 is shown in FIG. 1. On the left-hand side, as seen in FIG. 7, the second storage element 10 is located on the desk 18 in the inverted condition the same as that seen in FIG. 6. The two storage elements 10 are disposed such that their first ends 25 face each other with the access opening 41 of each pocket in opposition to each other and with the backs 22 of the each of the storage unit elements 10 parallel to each other. The one end of the privacy panel 12 is received in the slide pocket 40 of the right hand side, first storage element 10 and the other end of the privacy panel 12 is received in the slide pocket 40 of the left hand side, second storage element 10 such that there is a captured portion at each end of the privacy panel 12 received within a respective slide pocket 40 and there is a free portion 58 of the privacy panel in between the two storage elements 10 external of these slide pockets 40. The privacy panel 12 is slidable within each of the slide pockets 40 and thus the same storage elements 10 and privacy panel 12 can extend different lengths and thus be adapted to accommodate desks of different lengths between the first edge 66 and second edge 67.

Figure 8:
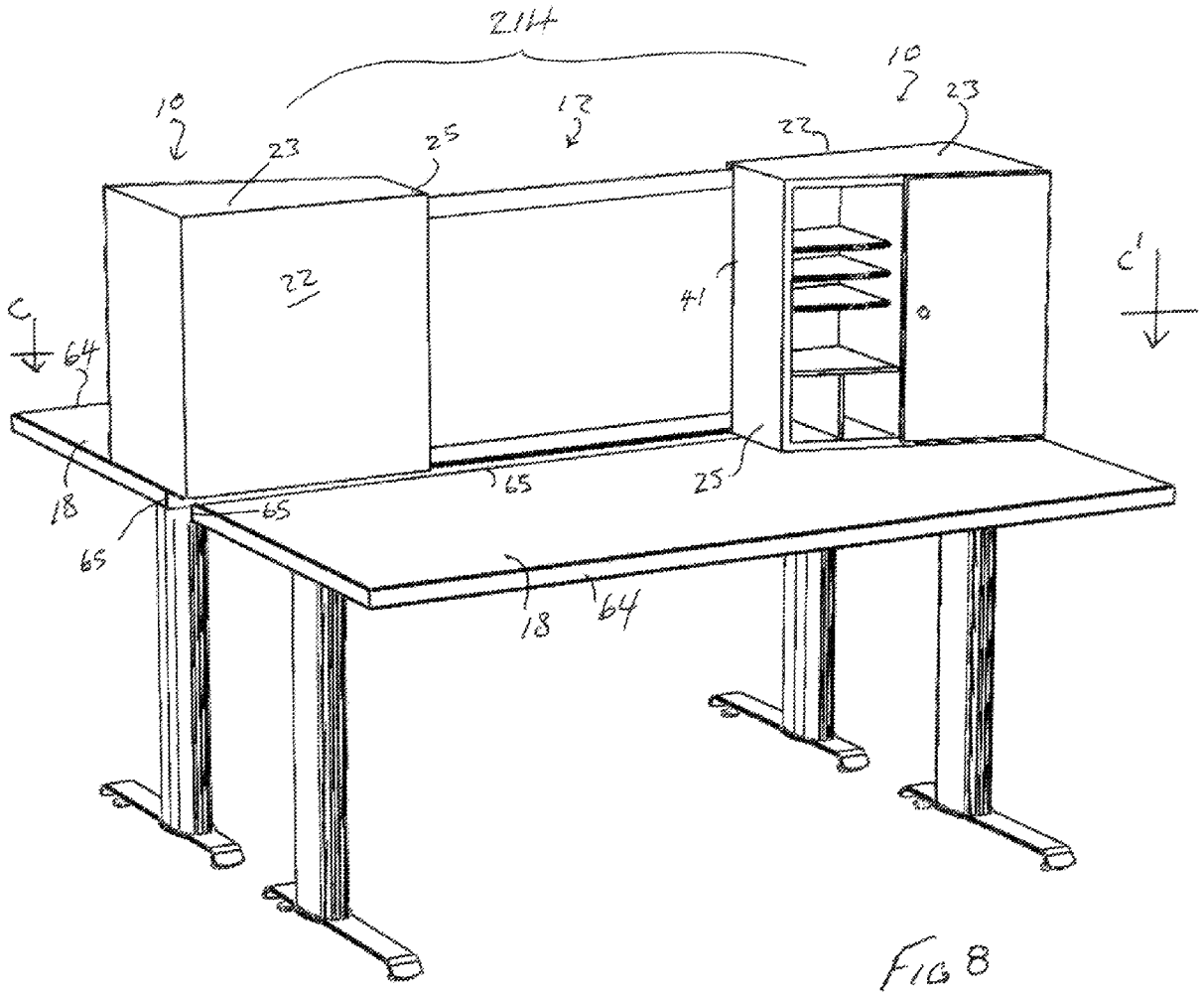
FIG. 8 is a pictorial front view of the storage elements and privacy panel of the first embodiment of FIG. 1 arranged as a storage and panel assembly in a third configuration mounted on two desks.

Reference is made to FIG. 8 which illustrates a storage and panel assembly 214 in a third configuration utilizing two storage elements 10 of the same construction as shown in FIG. 2 in combination with a single privacy panel 12 the same as that shown in FIGS. 1 to 5 but with the levelling foot 78 removed. As seen in FIG. 8, two desks 18 are provided each with a support surface 16. Each desk 18 has a rear edge 65 which is in opposition to the rear edge 65 of the other desk and parallel thereto. The opposed rear edges 65 may abut or may be spaced from the each other. As seen in FIG. 8, on the right-hand side of the forwardmost desk, the storage element 10 is disposed in a normal condition being the same as that in which the storage element 10 is shown in FIG. 1. On the left-hand side, as seen in FIG. 8, the second storage element 10 is located on the second rear desk 18 also in a normal condition, albeit, directed towards the front edge 64 of the second desk 18. The two storage elements 10 are disposed such that their first ends 25 face each other with the access opening 41 of each pocket in opposition to each other and with the backs 22 of the each of the storage unit elements 10 parallel to each other. As seen in the cross-sectional top view of FIG. 9, the first end 51 of the privacy panel 12 is received in the slide pocket 40 of the right hand side, first storage element 10 and the second end 52 of the privacy panel 12 is received in the slide pocket 40 of the left hand side, second storage element 10 such that there is a captured portion 57 at each end of the privacy panel 12 received within a respective slide pocket 40 and there is a free portion 58 of the privacy panel in between the two storage elements 10 external of these slide pockets 40. Privacy panel 12 is slidable within each of the slide pockets 40 and thus the same storage elements 10 and privacy panel 12 can extend different lengths and thus be adapted to accommodate desks of different lengths between their first edge 66 and second edge 67.

Figure 9:
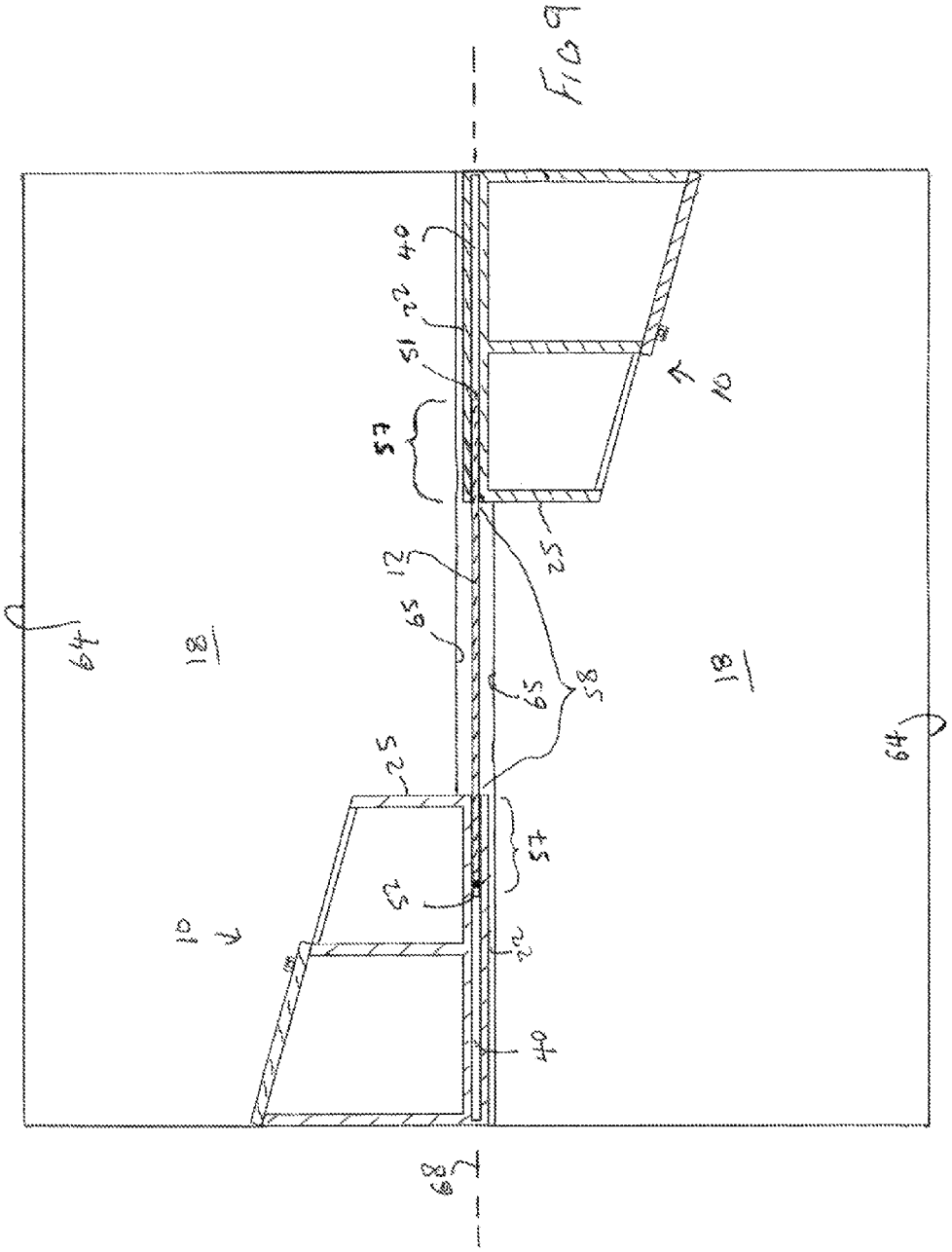
FIG. 9 is a cross-sectional top view of the storage and panel assembly of FIG. 8 along section line C-C' in FIG. 8.

As seen in the cross-sectional top view of FIG. 9, a broken line represents a vertical center plane 68 between the rear edges 65 of the desks 18. To enhance appearance, the privacy panel 12 is preferably disposed such that a longitudinal center plane of the privacy panel 12 is disposed coplanar with the center plane 68. This is accomplished by locating each of the storage elements 10 to extend beyond the rear edge 65 of the desk 18 such that each back 22 is located to extend beyond the rear edge 65 of the desk 18 upon which each storage element 12 is principally supported. Preferably, the pads 75 may be located on the bottom 24 and top 23 forwardly from the back 22 such that each storage element 10 is merely supported on one desk 18 and is not supported by both desks, although this is not necessary. Insofar as the rear edges 65 of the desks may be desired to be spaced, for example, to permit utility wiring to pass downwardly between the rear edges 65, a storage element 10 can be cantilevered over the rear edge 65 a reasonable distance by suitable configuration of the storage element 10 and selecting the spacing between the rear edges 65 of the desks to be appropriate as, for example, one inch or two inches as to facilitate easy passage of electrical wires or lugs.

Figure 10:
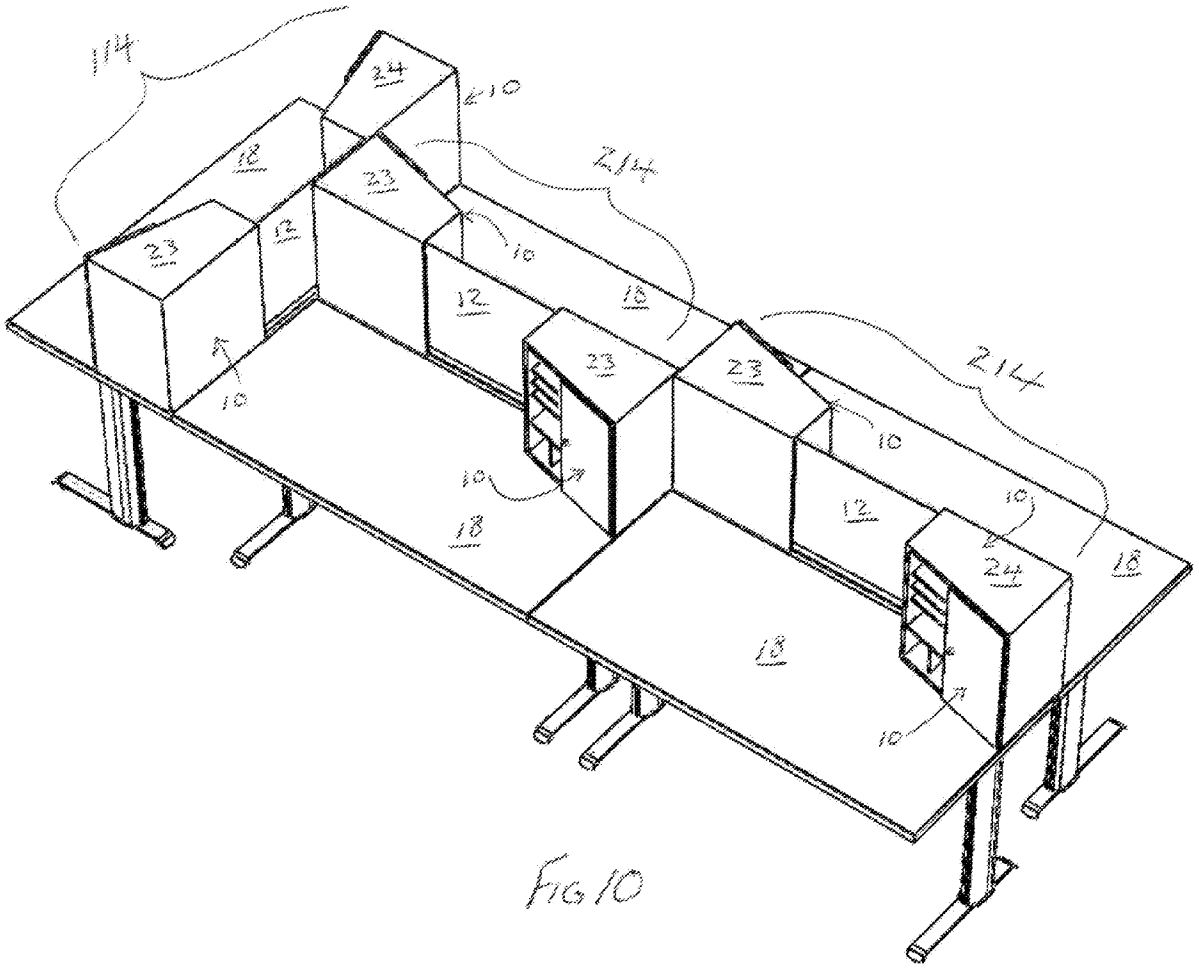
FIG. 10 is a pictorial top view showing five desks on which there are supported storage elements and privacy panels in accordance with the first embodiment of the invention arranged to form a storage and panel assemblies in accordance with the second orientation and the third orientation.

Reference is made to FIG. 10 which illustrates five desks 18 providing five workstations utilizing six identical storage elements 10 as in FIG. 2. In FIG. 10, on the right-hand side, there is a pair of back to back desks 18 in which the storage elements 10 are disposed in the same third orientation as illustrated in FIG. 8 forming the storage and panel assembly 214, that is, with each of the storage elements 10 being in the same condition, preferably a normal condition although both of the storage elements 10 could be in the inverted condition.

In FIG. 10, the fifth table is shown as disposed with its rear edge 65 abutting the first edge 66 and second edge 67 of a pair of adjacent back to back tables 18. On this fifth table 18, two storage units 10 are shown with one storage unit 10 in a normal condition and the other storage unit 10 in an inverted condition such that both storage units facing the same direction towards the front edge 64 of the fifth desk 18 with a privacy panel 12 to extend along the rear edge 65 of this fifth transverse desk 18 as in the second configuration of a storage and panel assembly 114 shown in FIG. 7.

Figure 11:
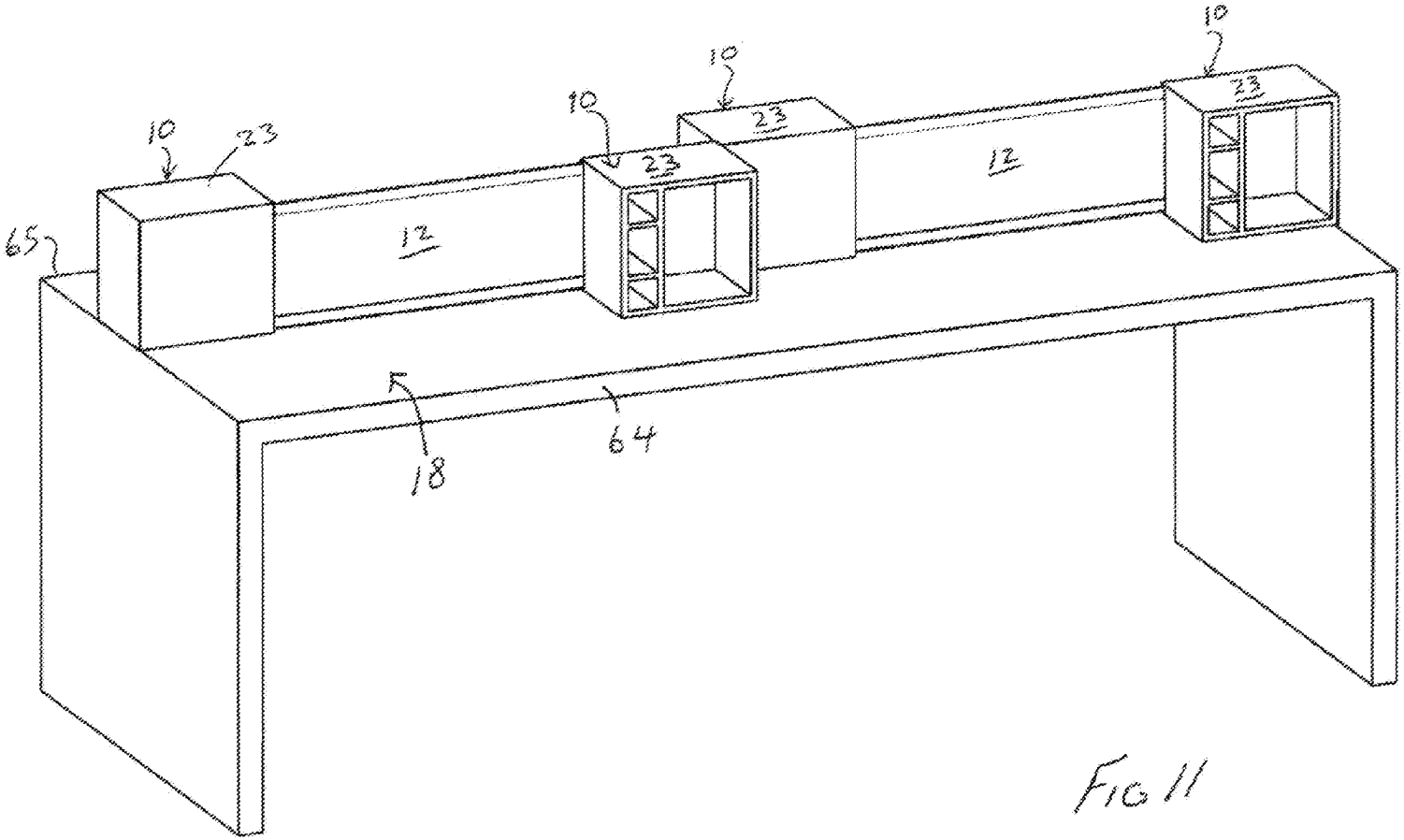
FIG. 11 is a perspective view of storage elements and privacy panels in accordance with a second embodiment of the invention mounted on a desk to form storage and panel assemblies in accordance with the second orientation.

Reference is made to FIG. 11 which illustrates storage for identical elements 10 and two privacy panels 12 in accordance with the third embodiment of the invention. In FIG. 10, but a single desk 18 is provided with a continuous support surface 16 of sufficient size that there is a workstation on each of the front edge 64 and the rear edge 65 of this desk 18 and with workstations provided such that some persons will sit or stand on the front edge 64 of the desk and other persons will sit on the rear edge 65 of the desk. Each storage element 10 has a construction substantially the same as that shown in the first embodiment of the storage element 10 as in FIG. 2, however, the storage element 10 is shown as being rectangular and of constant depth between its back 22 and front 21. Each storage unit 10 has the same internal slide pocket 40 as in FIG. 2 which opens to access opening 41 in the first end 25 of each storage unit 10, but is closed at the second end 26. In FIG. 10, there are locations for four persons to work with each person having their own storage unit 10. Pairs of the storage elements have a privacy panel 12 extend between them forming the second configuration of a storage and panel assembly 114.

Figure 12:
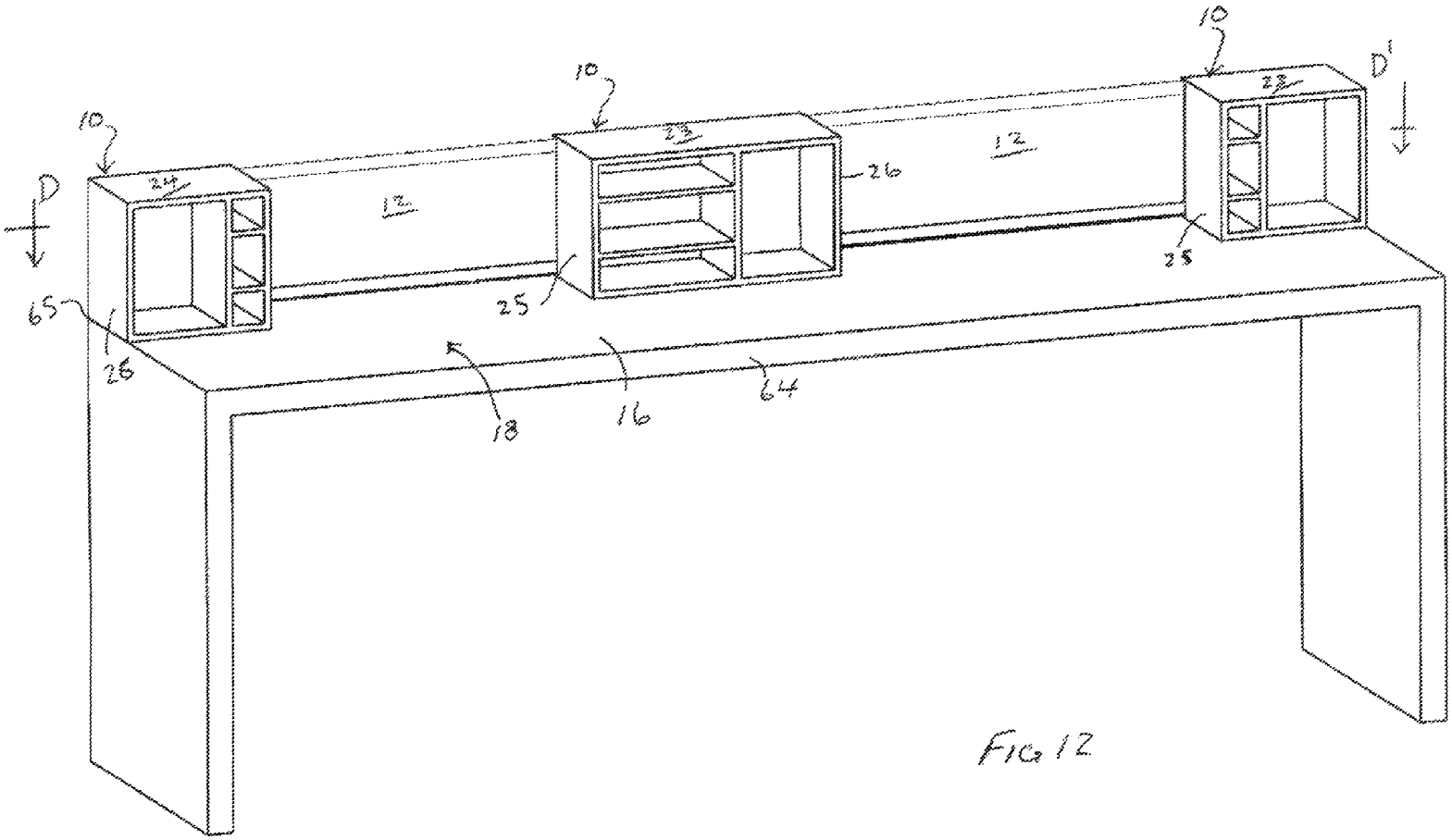
FIG. 12 is a perspective view of storage elements and privacy panels in accordance with a second and a third embodiment of the invention mounted on a desk to form storage and panel assemblies in accordance with a fourth orientation.
Figure 13:
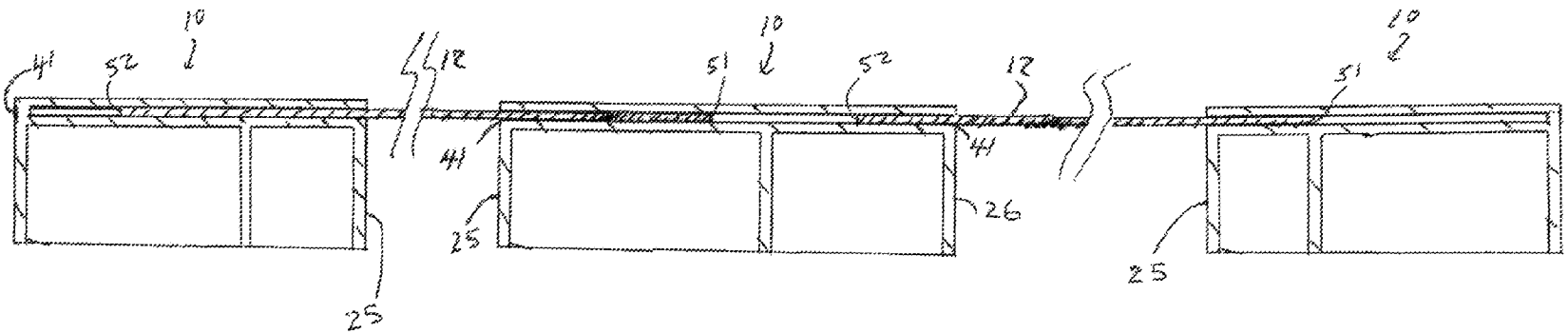
FIG. 13 is a cross-sectional top view along section line D-D' in FIG. 12.

Reference is made to FIGS. 12 and 13 which illustrate two identical end storage elements 10, the same as in FIG. 11, one in a normal condition and the other in an inverted condition the same as that shown in FIG. 11, however, in combination with a different middle storage cabinet 10 whose slide pocket 40 has two access openings 41, one in each of the first end 25 and the second end 26 as best seen in the top cross-section of FIG. 13. In FIGS. 12 and 13, two privacy panels 12 are provided, one coupled between the left-hand side storage element 10 and the middle storage element 10 and the other coupled between the middle storage element 10 and right hand side storage element 10. Thus, the middle storage cabinet 10 receives two privacy panels 12, with each extending outwardly from the slide pocket 40 through a respective of the two access openings 41. In the embodiment as shown in FIG. 12, the middle storage element 10 need not be invertible, but preferably is.

Figure 14:
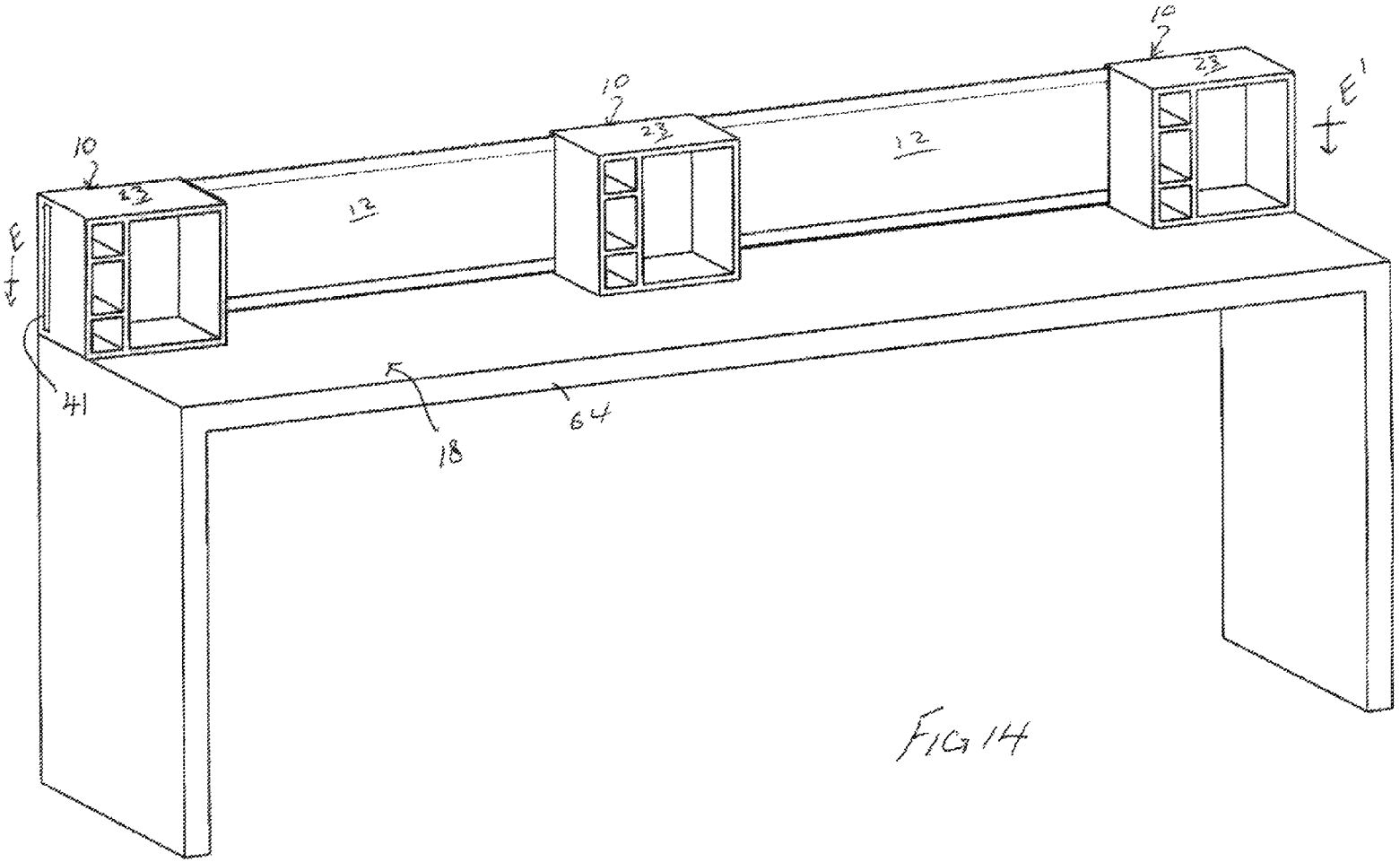
FIG. 14 is a front perspective view showing storage elements in accordance with a fourth embodiment of the invention arranged to provide a storage and panel assembly in accordance with a fifth orientation.
Figure 15:
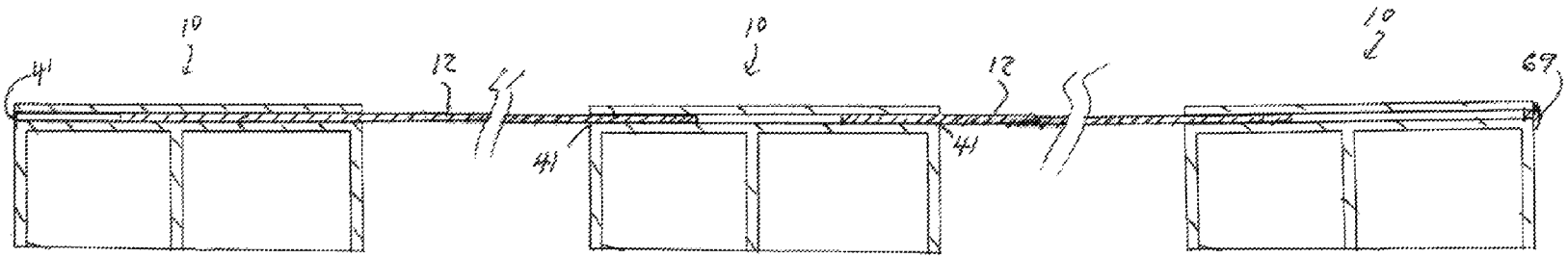
FIG. 15 is a cross-sectional top view along section line EE' in FIG. 14.

Reference is made to FIGS. 14 and 15 which illustrate three identical storage elements 10 similar to that shown in FIG. 11, however, in which the slide pocket 40 has two access openings 41, one in each of the first end 25 and the second end 26 as best seen in the top cross-section of FIG. 15. In FIGS. 14 and 15, two privacy panels 12 are provided, one coupled between the left-hand side storage element 10 and the middle storage element 10 and the other coupled between the middle storage element 10 and right hand side storage element 10. Thus, the middle storage cabinet 10 receives two privacy panels 12, with each extending outwardly from the slide pocket 40 through a respective of the two access openings 414. On the right hand side storage cabinet 10 and the left hand side storage cabinet 10, the access opening 41 that does not have a privacy panel 12 extend through it, may be left open as shown on the left-hand side of storage unit 10 in FIG. 15, however, a removable cover cap 69 may be frictionally inserted into the access opening 41 as schematically shown in FIG. 12 in top view on the right hand side. In the embodiment as shown in FIG. 14, the storage elements 10 need not be invertible, however, preferably are invertible.

Reference is made to FIGS. 16 to 21 which show a storage element 10 in accordance with a fifth embodiment. The storage element 10 has a configuration similar to that shown in FIG. 3, however, modified so as to provide in the first end 25 an outlet 70 for utilities comprising an electrical plug and a USB electrical charging socket. The outlet 70 is electrically connected via a flexible connection wiring 72 as to an electrical plug 73. An seen in FIG. 17, the storage cabinet 10 has an access opening 41 at the first end 25 and the slide pocket 40 is closed at the second end 26. The wiring 72 extends from the storage element 10 from the bottom 24 proximate the corner of the bottom 24 where the second end 26 meets the back 22 so as to not interfere with the sliding of the privacy panel 12 within the majority of the length of slide pocket 40 as it extends inwardly from the access opening 41. While not necessary, if desired, a stop member 120 may be provided within the slide pocket 40 secured between the outer rear wall panel 32 and the inner rear wall panel 36 to prevent sliding of a privacy panel 12 into engagement with the wire 72 as it extends through the opening 106.

Figure 17:
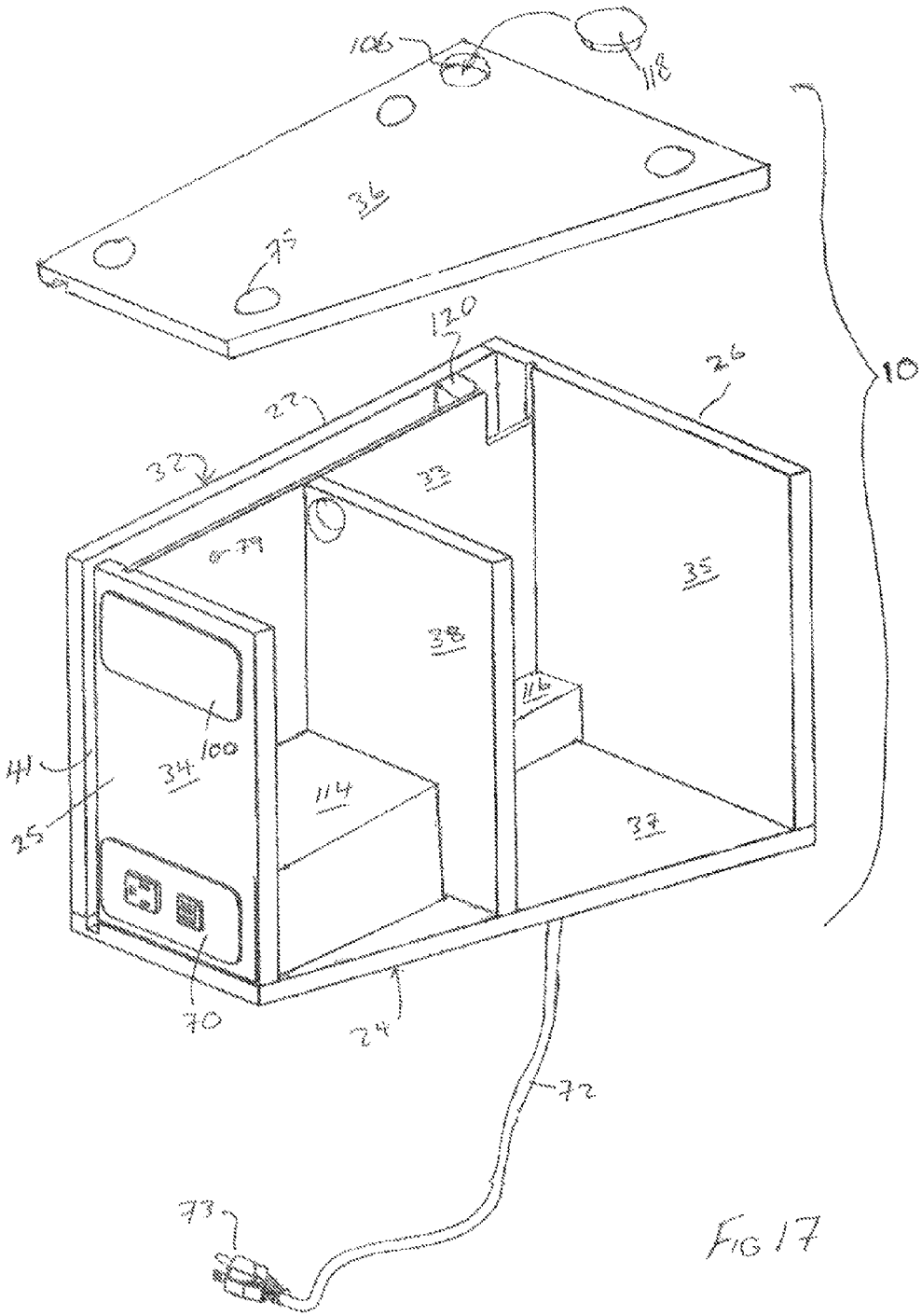
FIG. 17 is a front perspective view of the storage element of FIG. 16 showing the top panel displaced.
Figure 18:
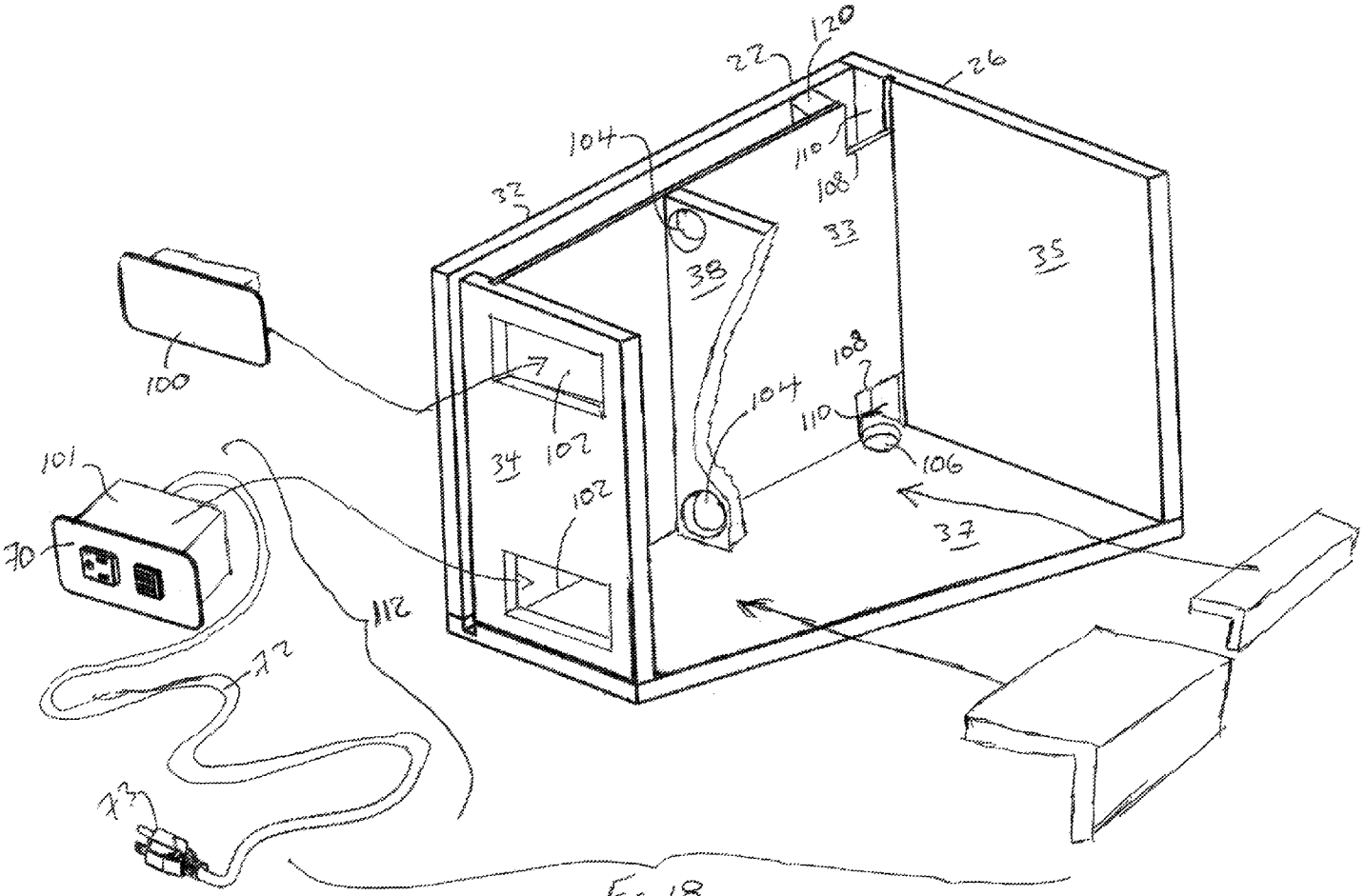
FIG. 18 is a partially exploded front perspective view of the storage element of FIG. 16 with the top panel removed and an outlet and plug assembly displaced.
Figure 19:
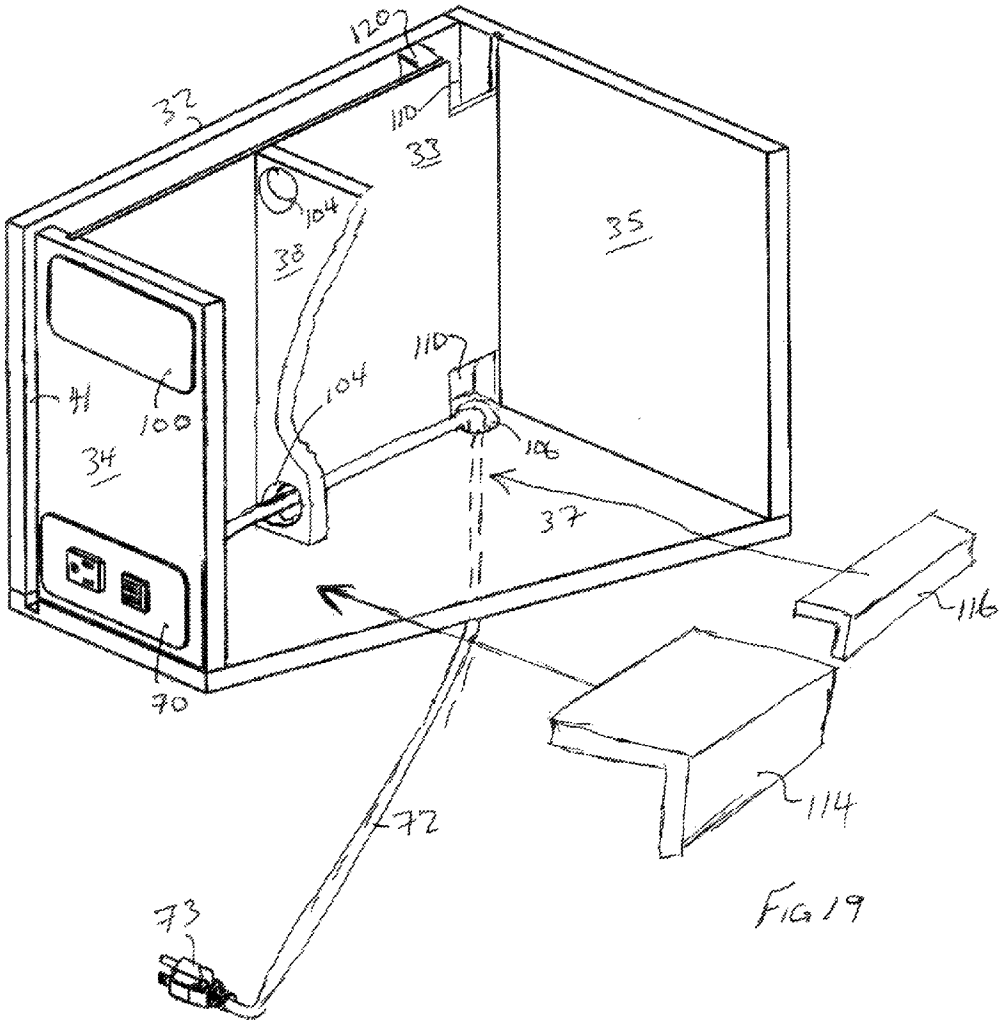
FIG. 19 is a partially exploded front perspective view of the storage element as in FIG. 18 but with the outlet and plug assembly installed.

FIG. 18 shows an exploded pictorial view with the outer rear wall panel 32, inner rear wall panel 33, bottom wall panel 37, first end wall panel 34, the second end wall panel 35 and a divider panel 38 assembled. The divider wall panel 38 is partially cut away for ease of illustration. The first end wall panel 34 has a pair of rectangular openings 102 spaced vertically from each at symmetrical locations. Each of the openings 102 is adapted to receive in a snap-fit either a housing 101 for the outlet 70 or a cover plug 100. The divider wall panel 38 has a pair of circular openings 104 at its upper rear and lower rear corners, each being the same and symmetrically located. The bottom wall panel 38 has a circular opening 100 in its corner near the back 22 and the second side 26. The opening is disposed to at least be partially underneath and in line with the slide pocket 40 so as to locate the opening 106 as close to the rear 22 as possible. As seen in FIG. 17, the top wall panel 36 has a corresponding opening 106 therethrough such that the top wall panel 36 and the bottom wall panel 37 are mirror images of each other. The inner rear wall panel 33 has two rectangular slotways 108 removed from its top and bottom edges proximate the second end 26 and providing openings 110 via which communication is provided through the inner rear wall panel 33 to the openings 106. The outlet 70, the casing 101 for the outlet 70, the wiring 72 and the plug 73 provide an electrical module 112 which can be removably coupled to an assembled storage element 10 in a manner now described. The plug and wiring 72 are fed through the lower opening 102 and the outlet casing 101 secured in a friction manner in the lower outlet 102. The plug 73 and wiring 72 are then fed through the opening 104 and via the opening 110 down through the opening 100 to adopt a configuration as illustrated in FIG. 19. The cover plug 100 is inserted in a snap-fit in the upper of the openings 102. An outlet cover 114 in the form of an L-shaped member is slid rearwardly into the compartment bordered by the first end wall panel 34 and the divider wall panel 38 to have a vertical of its legs sit upon the bottom wall panel 37 and a horizontal of its legs to engage preferably in snap-fit against the inner rear wall panel 33 and to thus hide and protect the rear of the outlet casing 101 and the wiring 72 between the first end wall panel 34 and the divider wall panel 38. Next, a wiring cover 116 is secured in a snap-fit between the divider wall panel 38 and the second end wall panel 35 bridging between the bottom wall panel 37 and the inner rear panel 33 and thus covering the wiring 72 between the divider wall panel 38 and the second end wall panel 35.

Figure 16:
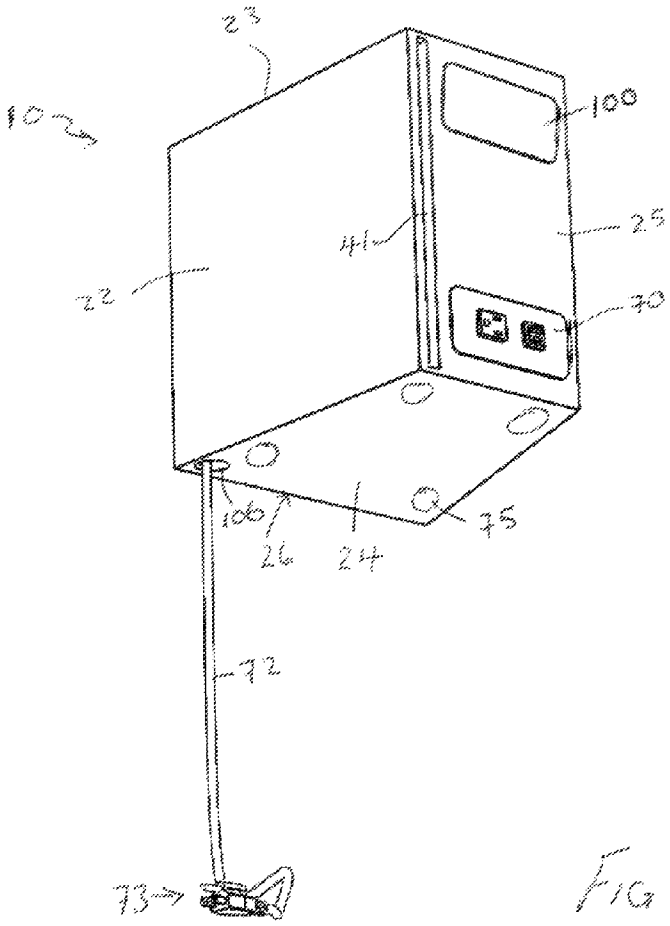
FIG. 16 is a rear bottom perspective view of a storage element in accordance with a fifth embodiment of the present invention.

As can be seen in FIG. 17, assembly is completed by a snap-fit cover cap 118 being engaged within the opening 106 of the top wall panel 36 as shown by the arrow in FIG. 17. The assembly above described results with the storage element 10 as illustrated in FIG. 16 adapted for use in a normal configuration. The construction, however, permits the storage element 10 in the normal condition of FIG. 16 to be reconfigured for use in an inverted configuration by reversal of the assembly steps described, inverting the storage element 10 and then repeating the assembly steps, of course, with the wiring 72 to then result in extending downwardly through the opening 106 in the top panel 36.

The wiring 72 could alternately extend from the storage element 10 out the second side 26. The wiring may be configured at any position along the rear of the storage element 10 if it is disposed to extend underneath the slide pocket 40.

The outlet 70 is shown as including an electrical plug and a USB electrical plug. Either one may be substituted for a communications socket although this is often unnecessary given the use of WiFi and wireless computer network systems. The storage compartment of FIGS. 16 to 19 may be made invertible by suitable location of the exit of the wiring 72.

Figure 20:
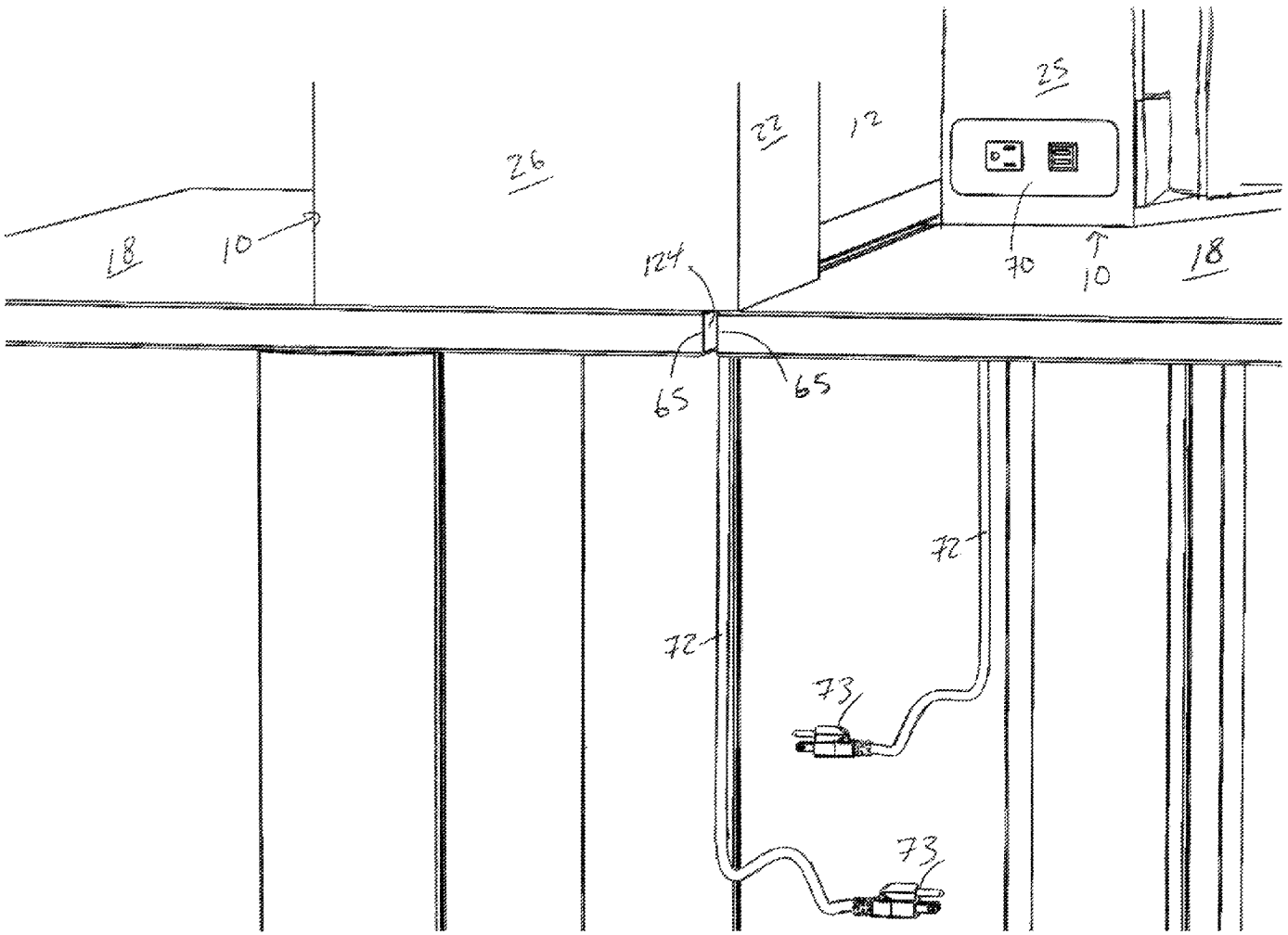
FIG. 20 is a partial rear pictorial view of two storage elements of FIG. 16 mounted with a privacy panel on a desk in the second configuration as in FIG. 8.

Reference is made to FIG. 20 which illustrates a perspective view of one end of a back-to-back desk arrangement such as illustrated in FIG. 8, however, utilizing storage element 10 with an electrical outlet such as shown in FIG. 16. As can be seen in FIG. 20, each of the storage units are arranged such that their back 22 is disposed to extend rearwardly beyond the rear edge 65 of the desk on which they are supported so as to locate the openings 106 vertically above a gap 122 between the ends 65 of the back-to-back desks 18 such that the wires 72 may extend vertically downwardly through the gap.

Preferably, the storage element 10 is made from materials which have a sufficient mass that the storage element sits securely on the support surface 16. Preferably, the mass of the storage element is sufficiently greater than the mass of the privacy panel so that the storage element 10 securely maintains the privacy panel 12 in the desired configuration. Preferably, the mass of the storage element 10 is at least twice the mass of the privacy panel and, more preferably, at least five or ten times the mass of the privacy panel.

In accordance with the preferred embodiment, the storage element 10 is not mechanically coupled to the desk 18 and is merely self-supporting on the support surface 16 of the desk. The storage element 10 may thus be freely manually moved to different locations on the desk and placed in a normal condition or an inverted condition at desired locations on different desks as may be desired. The privacy panel 12 similarly can readily be manually manipulated and slid into and out of the slide pocket 40 in each storage element 10 for suitable location as supported by one or more storage elements and/or the support surface 16. The privacy panels 12 may be provided with a number of different lengths to accommodate desks of different lengths, however, with the privacy panels 12 being able to extend into the slide pocket 40 to different extents, a single privacy panel 12 of one length can be adapted for use with a number of different length desks 18.

The storage element 10 may preferably be made from relatively inexpensive materials such as particle board which advantageously has relative substantial mass. The storage element 10 may be of a knock-down construction, to be shipped unassembled.

FIG. 3 shows a preferred construction of a storage element 10 in accordance with the present invention as adapted to be manufactured substantially from particle board other than the inner rear wall panel 33. This is but one suggested construction. For example, in FIG. 3, the first end wall panel 34 does not extend rearwardly past the access opening 41 and a rear edge of the first end wall panel 34 forms a forward edge of the access opening 41. This is not necessary. As an alternate construction, the first end wall panel 34 may extend rearwardly to the outer rear wall panel 32 with the access opening 41 to be provided as an opening through the first end wall panel 34.

While the storage element 10 may preferably be constructed on laminated wood or particle board panels as shown in the illustrations, a similar storage element 10 can be manufactured from sheet metal and other materials.

The storage element 10 can be modified to be provided with internal and external accessories including, for example, hinge doors which may or may not be provided with locks, shelves, dividers and integrated utility outlets such as those now shown. The utility outlets may be located to permit access externally of the storage compartment 42 or internally as behind a locked door as can be advantageous for relatively secure locking and engagement by, for example, a personal phone to be charged within the storage compartment 42.

Figure 21:
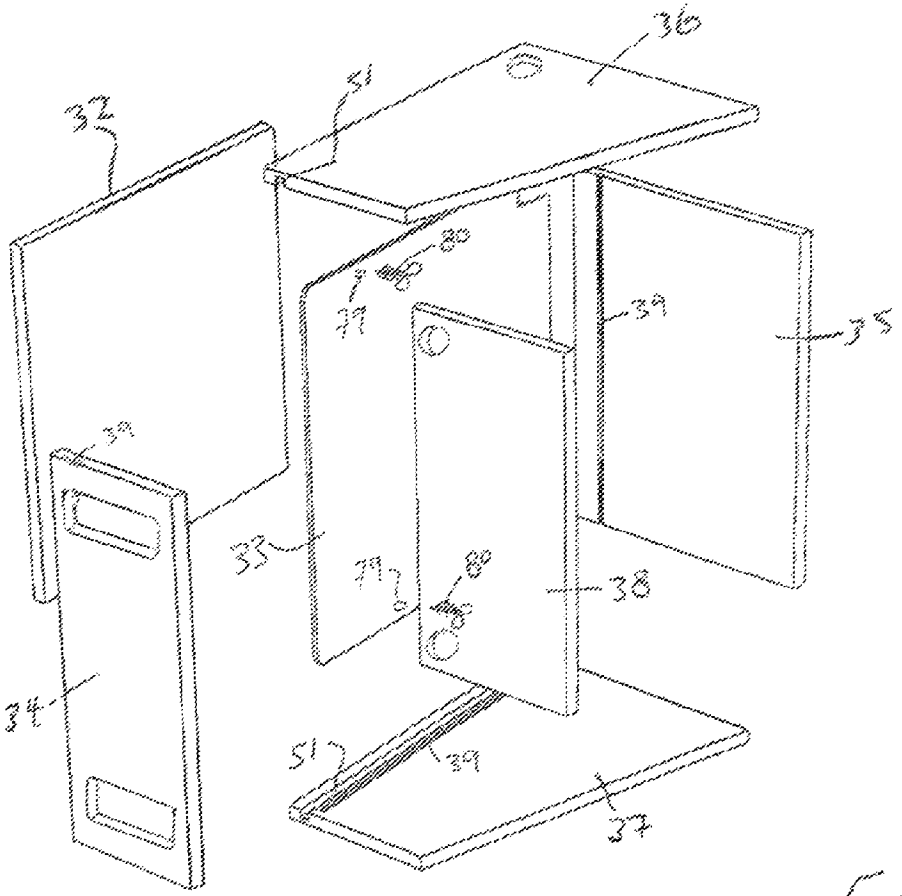
FIG. 21 is an exploded front perspective view of selected elements of the storage element of FIG. 16.

Reference is made to FIG. 21 which is similar to FIG. 3 and which shows main components of the storage element 10 of FIGS. 16 to 20 as including as in FIG. 3, the outer rear wall panel 32, the inner rear wall panel 33, the first end wall panel 34, the second end wall panel 35, the horizontal top wall panel 36, the horizontal bottom wall panel 37 and the divider wall panel 38 as are secured together in a manner as shown in FIGS. 17, 18 and 19. Unlike FIG. 3, in FIG. 21, each of the top wall panel 36 and the bottom wall panel 37 have a channels 51 cut in their interior surfaces to form part of the slide pocket 40 as with the bottom 56 of the privacy panel 12 to slide within the channel 51 of the bottom wall panel 37 and the top 55 of the privacy panel 12 to slide within the channel 51 of the top wall panel 36.

As seen in FIG. 21, the channels 51 form part of the slide pocket 40. In the embodiment of FIG. 21, the channel 51 in the bottom wall panel 36 has a bottom surface, a front surface and a rear surface. The rear surface is shown as flush with the front face of the outer rear wall panel 32. The bottom surface of the channel 51 forms the upwardly directed bottom guide surface of the slide pocket 40. The front surface of the channel 51 forms the rearwardly directed guide surface of the slide pocket 40. The rear surface of the channel 51 forms part of the forwardly directed guide surface of the slide pocket 40. When the storage element 10 of FIGS. 16 to 20 is in a normal condition, the bottom 56 of the privacy panel 12 slides within the channel 51 of the bottom wall panel 37. Similarly, if in an inverted condition, the top 55 of the privacy panel 12 is adapted to slide within the channel 51 of the top wall panel 36. Preferably in FIG. 21 a locking mechanism in the form of the screws 80 are provided to prevent sliding of the privacy panel in the slide pocket 40 in a desired position.

In FIG. 21, interior surfaces of each of the first end wall panel 34 and the second end wall panel 35, the top wall panel 36 and the bottom wall panel 37 carry respective slots 39 to securely receive therein edges of the inner rear wall panel 32, however, spaced marginally forwardly from the location of the slots 39 in FIG. 3. As can be seen in FIG. 17, a rear edge 50 of the first end wall panel 34 is located spaced forwardly from the outer rear wall panel 32. The width of the slide pocket 40 within the channels 51 and the width of the slide pocket 40 within the access opening 41 are both smaller than the width of the slide pocket 40 between the outer rear wall panel 32 and the inner rear wall panel 33. This can be advantageous to restrict the relative movement of the privacy panel 12 in the channels 51 and the access opening 41 yet facilitate ease of sliding of the privacy panel 12 inwardly from the access opening 41.

Figure 22:
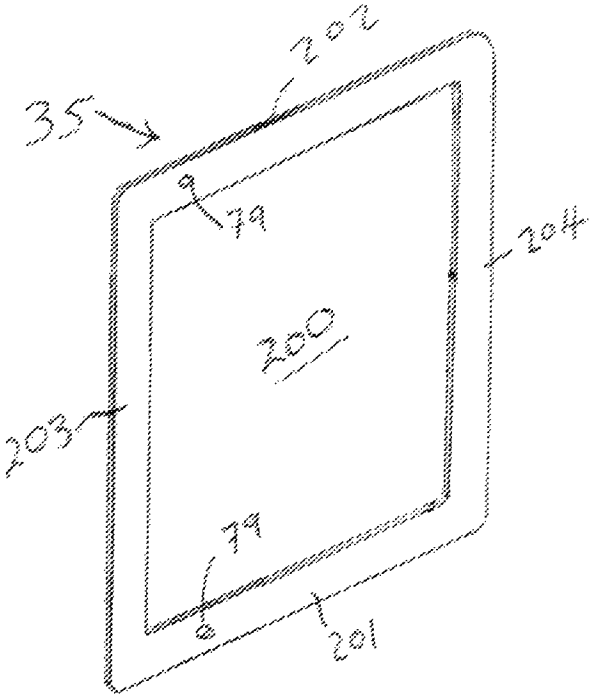
FIG. 22 is a front perspective view of a first alternate configuration of a privacy panel for use in either FIG. 3 or 21.

Reference is made to FIG. 22 which shows a front perspective view of a first alternate configuration for the inner rear wall panel 33 for use in substitution for the inner rear wall panel 33 in FIGS. 3 and 21. As seen in FIG. 22, inner rear wall panel 33 has a central opening 200 with a bottom border portion 201, a top border portion 202, a first end border portion 203 and a second end border portion 204 extending circumferentially about the central opening 200 through the inner rear wall panel 33. The inner rear wall panel 33 of FIG. 22 may be modified so as to eliminate one or both of the first end border portion 202 and the second end border portion 203.

Figure 23:
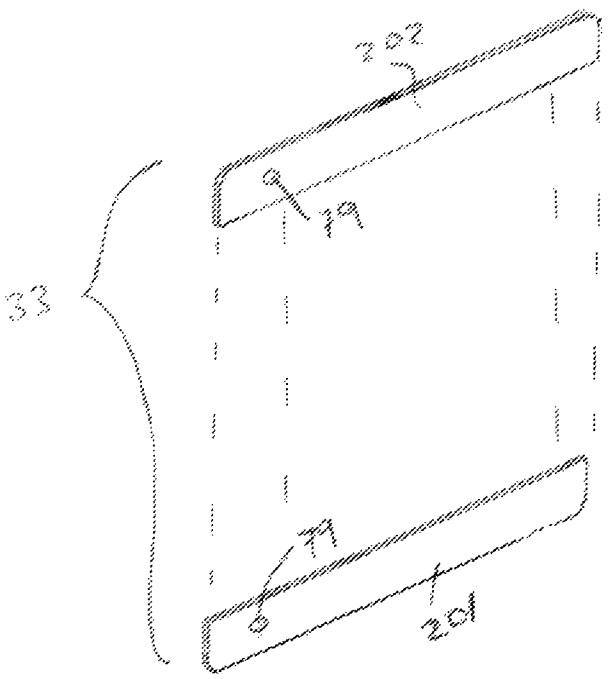
FIG. 23 is a front perspective view of a second alternate configuration of a privacy panel for use in either FIG. 3 or 21.

In this regard, FIG. 23 shows a front perspective view of a second alternate configuration for the inner rear wall panel 33 for use in substitution for the inner rear wall panel 33 in FIGS. 3 and 21. FIG. 23 shows an arrangement in which the inner rear wall panel 33 comprises merely the bottom border portion 200 and the top border portion 201 so as to not span fully between the top wall panel 36 and the bottom wall panel 37. The rearwardly facing front guide surface of the slide pocket 40 for constraining the privacy panel in the slide pocket 40 between the front guide surface and the rear guide surface of the outer rear wall panel 32 need not span between the top and the bottom or between the first end and the second end, and may be provided for example merely by the bottom border portion 200.

Figure 24:
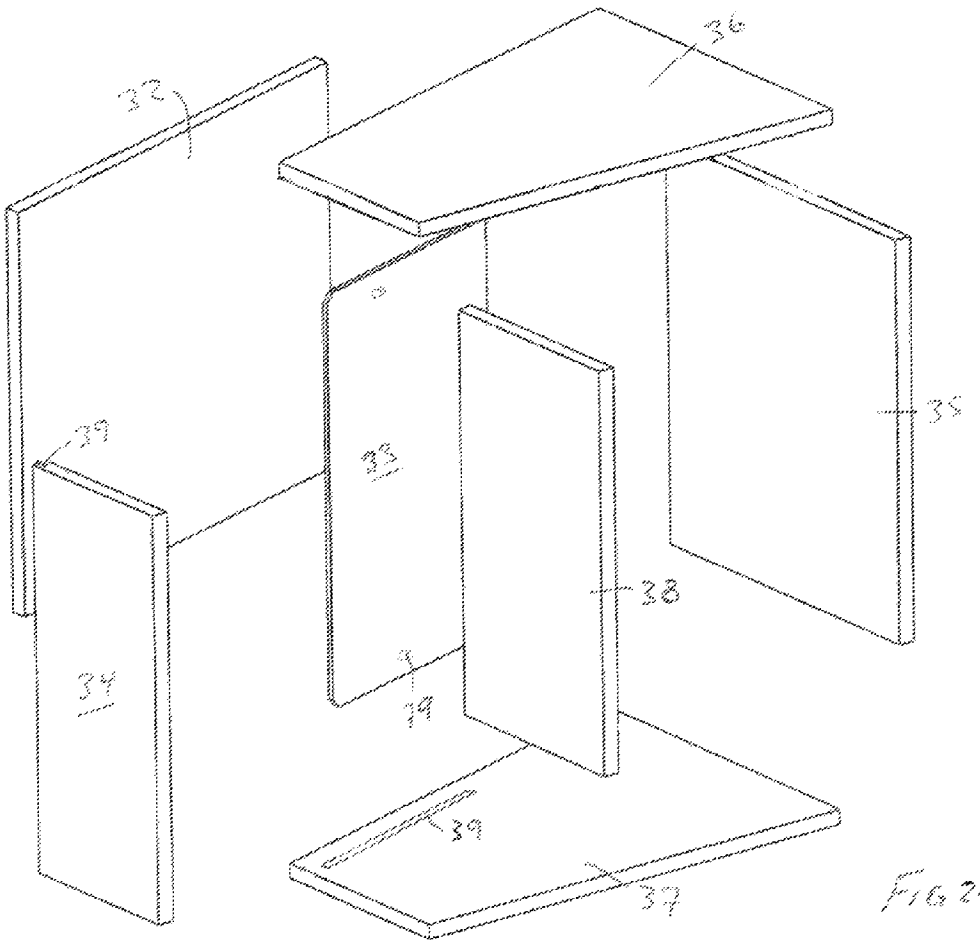
FIG. 24 is an exploded front perspective view of selected elements of a further embodiment of a storage element the storage element having similarities to the storage element of FIG. 3.

Reference is made to FIG. 24 which shows a front perspective view of the storage element similar to the storage element of FIG. 3 but showing a first alternate configuration of the storage element 10 the same as in FIG. 3 but for the differences that the inner rear wall panel 33 only partially spans from the first end wall panel 34 the toward the second end wall panel 35. In FIG. 24 one end of the inner rear wall panel 33 engaged in the rabbit-like slot 39 in the rear of the first end wall panel 34 and the other end of the inner rear wall panel 33 is secured and ends preferably to the rear of the divider wall panel 38. As seen in FIG. 24 the inner rear wall panel 33 does not need to span between the first end wall panel 34 and the second end wall panel 35 although it will preferably be provided for the distance that the privacy panel is to be slid inwardly from the access opening 40. Nevertheless the slide pocket in FIG. 24 extends and the privacy panel may slide in the slide pocket to the second end wall panel 35 past the other end of the inner rear wall panel 33, unless a stop member such as 120 shown in FIGS. 17, 18 and 19 may be provided.

As seen in FIGS. 3, 21 and 24, the privacy panel 14 is supported in the slide pocket 14 constrained between the forwardly directed rear guide surface of the slide pocket 40, provided as the forward face of the outer rear wall panel 32 and the rear face of the access opening 40 and/or the rear face of the channel 51, and the rearwardly directed front guide surface of the slide pocket 40, provided as the rear face of the inner rear wall panel 33, the front face of the access opening 41 and/or the front face of the channel 51. The rear face of the access opening 41 preferably forms a first portion of the rearwardly directed front guide surface and the front face of the access opening 40 preferably forms a first portion of the forwardly directed rear guide surface, with these two first portions for constraining the privacy panel disposed vertically in the access opening 41 against any substantial front to rear movement. With privacy panel 14 so constrained in the access opening 41, the slide pocket 40 merely additionally needs a second portion of the rearwardly facing front guide surface to be located between the first end and the second end spaced from the access opening 41 for constraining the privacy panel 14 in the slide pocket 40 between the front guide surface and the outer rear wall panel 32, and the front guide surface need not be continuous between the first end and the second end.

While the invention has been described with reference to preferred embodiments, many modifications and variations of the invention will now occur to persons skilled in the art. For a definition of the invention, reference is made to the following claims.

I claim:

1. In combination a privacy panel and at least one storage element:

the storage element comprising:

a front, a back, a top extending between the back and the front, a bottom spaced vertically from the top extending between the back and the front, a first end extending between the top and the bottom and between the back and the front, and a second end between the top and the bottom opposite the first end and between the back and the front;

a vertical outer rear wall panel forming the back of the storage element;

a storage compartment open forwardly to the front between the top, the bottom, the first end, and the second end;

a vertically and horizontally extending slide pocket defined forward of the outer rear wall panel, parallel to the outer rear wall panel, and open to at least one of the first end and the second end via an access opening in a respective one of the first end and the second end;

the privacy panel comprising a thin sheet member with, a first end and a second end;

the privacy panel coupled to storage element with a captured portion of the privacy panel including the first end received within the pocket and with a free portion of the privacy panel external of the pocket extending out of the pocket via the access opening to the second end of the panel external of the pocket;

the captured portion horizontally slidable in the pocket through the access opening;

wherein when the captured portion of the privacy panel is received within the pocket with the privacy panel extending out of the pocket to the second end external of the pocket, engagement between the privacy panel and the pocket maintaining the privacy panel disposed vertical parallel to the outer rear wall panel.

2. The combination as claimed in claim 1 wherein the slide pocket includes a rearwardly facing front guide surface located between the first end and the second end spaced from the access opening for constraining the privacy panel in the slide pocket between the front guide surface and the outer rear wall panel.

3. The combination as claimed in claim 2 wherein the access opening has a rearwardly directed front guide surface and a forwardly directed rear guide surface for constraining the privacy panel in the slide pocket between the front guide surface and the rear guide surface.

4. The combination of claim 3 wherein the bottom is adapted for supporting the storage element on a horizontal surface.

5. The combination of claim 4 wherein the top is adapted for supporting the storage element on the horizontal surface.

6. The combination as claimed in claim 1 further including an inner rear wall panel extending parallel to the outer rear wall panel spaced forward from the outer rear wall panel;

the slide pocket defined between the outer rear wall panel and the inner rear wall panel.

7. The combination as claimed in claim 6 wherein the storage compartment is forward of the inner rear wall panel.

8. The combination of claim 6 wherein:

the first end comprising a first end wall panel wall extending between the top and the bottom, the second end comprising a second end wall panel wall extending between the top and the bottom opposite the first end wall panel, the inner rear wall panel extending between the first end wall panel and the second end wall panel, in the outer rear wall panel extending between the first end and the second end wall panel, the top comprises a horizontal top wall panel extending between the first end wall panel and the second end wall panel, the bottom comprises a horizontal bottom wall panel spaced vertically from the top wall panel and extending between the first end wall panel and the second end wall panel, and the outer rear wall panel extending between the first end and the second end wall panel and extending between the top wall panel and the bottom wall panel.

9. The combination of claim 8 wherein the pocket is defined between the outer rear panel and the inner rear wall panel and between the top wall panel and the bottom wall panel.

10. The combination of claim 1 wherein the privacy panel is removable from the pocket by sliding of the captured portion into and out of the pocket and the privacy panel when removed is reinsertable into the pocket by sliding of the captured portion into the pocket.

11. The combination of claim 1 wherein the storage element is invertible and adapted for use either in a normal orientation with the bottom supporting the storage element on a horizontal support surface or in an inverted orientation with the top supporting the storage element on the horizontal support surface.

12. The combination of claim 1 wherein the pocket is open via the access opening at the first end and the pocket is closed at the second end.

13. The combination of claim 1 wherein the privacy panel having a vertical cross-sectional size and shape complementary to a vertical cross-sectional size and shape of the pocket whereby when the captured portion of the privacy panel is received in the pocket engagement between the captured portion of the privacy panel and pocket maintains the privacy panel disposed vertical parallel to the outer rear wall panel.

14. The combination of claim 1 wherein the bottom is adapted for supporting the storage element on a horizontal support surface with the storage unit supporting the bottom of the privacy panel over the captured portion of the privacy spaced a first distance from the horizontal support surface, the bottom of the privacy panel on the free portion of the privacy panel supports the privacy panel on the horizontal support surface spaced vertically from the horizontal support surface by a second vertical distance equal to the first vertical distance.

15. The combination of claim 1 wherein the storage element has a mass, and the storage panel has a mass, the mass of the storage element is at least twice the mass of the privacy panel.

16. The combination of claim 1 wherein the storage element includes an electrical power or a communication outlet and a flexible connection wiring for connection of the outlet with a source of electrical power or communication, the pocket is open via the access opening at the first end and the pocket closed at the second end, the outlet is provided in a location selected from the storage compartment, the front, and the first end, and the wiring extends either from the storage element at the second end or from the storage element from the rear panel proximate the second end.

17. In combination a privacy panel and two storage elements, namely a first storage element and a second storage element:

each storage element comprising:

a front, a back, a top extending between the back and the front, a bottom spaced vertically from the top extending between the back and the front, a first end extending between the top and the bottom and between the back and the front, and a second end between the top and the bottom opposite the first end and between the back and the front;

a vertical outer rear wall panel forming the back of the storage element;

a storage comportment open forwardly to the front and defined between the top, the bottom, the first end, and the second end;

a slide pocket defined forward of the inner rear wall panel parallel to the outer rear wall panel;

the pocket open to at least one of the first end and the second end via an access opening in a respective one of the first end and the second end;

the privacy panel comprising a thin sheet member with a first end and a second end;

the privacy panel removably coupled to each storage element with a first captured potion of the privacy panel including the first end received within the pocket of the first storage unit, a second captured portion of the privacy panel including the second end receded within the pocket of the second storage element and with a free portion of the privacy panel between the first captured portion and the second captured portion external of the pockets extending out of the pockets via the access openings and between the first storage element and the second storage element;

the first captured portion horizontally slidable in the pocket of the first storage unit through the access opening, the second captured portion horizontally slidable in the pocket of the second storage unit through the access opening, wherein when the first storage element and the second storage element are supported on a support surface with the outer rear panel of the first storage element disposed in the same plane as the outer rear panel of the second storage element, with the first captured portion of the privacy panel received within the pocket of the first storage element and the second captured portion of the privacy panel received within the pocket of the second storage element, engagement between the privacy panel and the pockets maintains the privacy panel disposed parallel to both the outer rear wall panel of the first storage element and the outer rear wall panel of the second storage element.

18. The combination of claim 17 wherein:

the first storage element and the second storage element are identical, each of the first storage element and the second storage element is invertible and adapted for use either in a normal orientation with the bottom supporting the storage element on a horizontal support surface or in an inverted orientation with the top supporting the storage element on the horizontal support surface, and the pocket in each of the first storage element and the second storage element is open via the access opening at the first end and the pocket closed at the second end.

19. The combination of claim 17 further including a desking arrangement with a worksurface comprising the horizontal support surface, the horizontal support surface having a first work area for a first user to be positioned adjacent a first edge of the worksurface facing the first work area and a second work area for a second user to be positioned adjacent a second edge of the worksurface opposite from the first edge facing the second work area and the first work area, the first storage element on the first work area with the front of the first storage element facing the first edge, the second storage element on the second work area spaced from the first storage element with the front of the second storage element facing the second edge, the privacy panel spanning between the first storage element and the second storage element received in the respective pocket of each.

20. The combination of claim 19 wherein the first work area ends at a first straight back edge and the second work area ends at a second back edge, the second back edge being parallel to the first back edge in opposition thereto on either side of a vertical center plane, the first storage element located on the first work area with its outer rear panel spaced away from the first edge from the first back edge and the second storage located on the second work area with its outer rear panel spaced away from the second edge from the second back edge, whereby the privacy panel in spanning between the first storage element and the second storage element received in the respective pocket of each storage element overlies the vertical center plane.

* * * * *